United States Patent [19]

Sakai et al.

[11] Patent Number: 4,945,031

[45] Date of Patent: Jul. 31, 1990

[54] IMAGE-FORMING PROCESS COMPRISING BLEACHING AT LOW PH A MATERIAL COMPRISING A CYAN COUPLER AND HYDROQUINONE

[75] Inventors: Minoru Sakai; Osamu Takahashi; Kozo Aoki, all of Kanagawa, Japan

[73] Assignee: Fuji Photo Film Co., Ltd., Kanagawa, Japan

[21] Appl. No.: 208,904

[22] Filed: Jun. 20, 1988

[30] Foreign Application Priority Data

Jun. 19, 1987 [JP] Japan ..... 62-152744

[51] Int. Cl.[5] ..... G03C 5/38; G03C 7/32; G03C 7/34

[52] U.S. Cl. ..... 430/393; 430/430; 430/438; 430/461; 430/481; 430/551; 430/552; 430/553; 430/607

[58] Field of Search ..... 430/551, 552, 553, 523, 430/496, 430, 461, 438, 481, 607, 353

[56] References Cited

U.S. PATENT DOCUMENTS

| | | | |
|---|---|---|---|
| 4,277,553 | 7/1981 | Onodera et al. | 430/551 |
| 4,277,558 | 7/1981 | Kikuchi et al. | 430/551 |
| 4,587,210 | 5/1986 | Ono et al. | 430/551 |
| 4,621,047 | 11/1986 | Kishimoto et al. | 430/430 |
| 4,745,048 | 5/1988 | Kishimoto et al. | 430/430 |
| 4,769,312 | 9/1988 | Kishimoto et al. | 430/430 |

FOREIGN PATENT DOCUMENTS

| | | |
|---|---|---|
| 255402 | 2/1988 | European Pat. Off. . |
| 60647 | 4/1985 | Japan . |

OTHER PUBLICATIONS

James, T. H., *The Theory of Photographic Process,* 1977, pp. 450–453.

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

An image-forming process, which comprises subjecting a multilayer silver halide color photographic material containing, in an oil droplet dispersion in a light-sensitive layer provided on a support, at least one of the diffusion-resistant oil-soluble couplers capable of coupling with an oxidation product of an aromatic primary amine developing agent to form a substantially non-diffusible cyan dye represented by the following formula (I) and at least one member selected from the compounds represented by the following formulae (II) and (III), to imagewise exposure and color development, and then processing the multilayer silver halide photographic material with a bleaching or bleach-fixing solution having a pH of 6.3 or less:

(I)

(II)

(III)

wherein:

Y represents —NHCO— or —CONH—;

$R_1$ represents an aliphatic group, an aromatic group, a heterocyclic group or an amino group;

X represents a hydrogen atom, a halogen atom, an aliphatic group, an alkoxy group or an acylamino group;

$R_2$ represents an alkyl group or an acylamino group or, when bound to X, non-metallic atoms forming a 5- to 7-membered ring;

Z represents a hydrogen atom or a group capable of being eliminated upon coupling with an oxidation product of a developing agent; and $R_3$, $R_4$, $R_5$, and $R_6$ each represents a hydrogen atom, a chain, cyclic or branched alkyl or alkylthio group, provided that $R_3$ and $R_4$, or $R_5$ and $R_6$, do not represent hydrogen atoms at the same time and that, when they represent alkyl groups, those which are bound to the benzene ring via a tertiary carbon atom are excluded.

18 Claims, No Drawings

IMAGE-FORMING PROCESS COMPRISING BLEACHING AT LOW PH A MATERIAL COMPRISING A CYAN COUPLER AND HYDROQUINONE

FIELD OF THE INVENTION

This invention relates to an image-forming process using a silver halide color photographic material and, more particularly, to an image-forming process which undergoes less deterioration of image during storage as prints by change in cyan dye density caused after color development processing.

BACKGROUND OF THE INVENTION

In forming color photographic images, light-sensitive layers containing three of yellow, magenta, and cyan color photographic couplers are imagewise exposed, and processed with a color developer containing a color developing agent. In this process, the couplers undergo a coupling reaction with an oxidation product of an aromatic primary amine to give colored dyes.

Standard processing steps for silver halide color photographic materials generally comprise a color-developing step wherein a color image is formed, a silver-removing step wherein developed silver and undeveloped silver are removed, and a washing and/or image-stabilizing step.

It has been intended to shorten the processing time and, recently, there has been an increasing necessity for shortening the processing time due to the request for shortening time for delivery of finished prints, reducing work in laboratories, and reducing the size and facilitating procedures of processing systems for small-scale laboratories called "mini-laboratories".

Shortening the time for the color-developing step can be attained by properly combining the technique of using those couplers which show as fast a coupling speed as possible, the technique of using those silver halide emulsions which show a rapid developing speed, and the technique of raising the temperature of the color developer.

Shortening the time for the silver-removing step can be attained by decreasing the pH of a bleaching solution and a bleach-fixing solution. Such acceleration of bleaching and fixing by decreasing pH of the bleach-fixing solution is described in "The Theory of the Photographic Process", Chap. 15, E., Bleach-Fix System.

However, acceleration of the bleaching step by decreasing the pH of the bleach-fixing solution involves a problem of deteriorating image quality, since dyes formed from cyan couplers are converted to their leuco form to be decolorized, and do not return to the colored form before completion of the processing (hereinafter this phenomenon being referred to as "color restoration failure"). This causes a decrease in density. After the processing, color restoration gradually proceeds to destroy color balance of the image.

In order to solve this problem, there is the technique of washing color-developed light-sensitive materials with water to remove color developing agent before the bleach-fixing step. However, this technique has defects, in that the number of processing step is increased and that the total processing time is prolonged.

Also, the technique of adding a water-soluble ionic compound containing a polyvalent element to the bleach-fixing bath is proposed in, for example, U.S. Pat. No. 3,773,510. However, this technique has defects, in that it increases environmental pollution and it fails to fully attain the essential object.

On the other hand, the use of hydroquinones or quinones for the purpose of controlling gradation, preventing fog, and preventing decoloration, and for other purposes, is conventionally known, for example, in Japanese Patent Application (OPI) Nos. 161238/80, 60647/85 and 32034/78 (the term "OPI" as used herein means an "unexamined published application"), West German Patent Application (OLS) Nos. 2,149,789 and 3,320,483, Japanese Patent Application (OPI) Nos. 24141/83 and 2128/71, Japanese Patent Publication Nos. 4934/68, 21249/75, and 3171/85, Japanese Patent Application (OPI) Nos. 106329/74 and 129535/74, British Pat. No. 1,465,081, Japanese Patent Application (OPI) Nos. 129536/74, 134327/74, 110337/75, 156438/75, 6024/76, 9828/76, 14023/76, 65432/77, 128130/77, 146234/77, 146235/77, 9528/78, 55121/78, 139533/78, 24019/79, 25823/79, 29637/79, 70036/79, 97021/79, 133181/79, 43521/80, 95948/80, 5543/81, 83742/81, 85748/81, 87040/81, 109344/81, 153342/81, 112749/82, 176038/82, 136030/83, 72443/84, 75249/84, 83162/84, 101650/84, 180557/87, 60647/85, 189342/84, 191031/84, 55339/85, and 263149/85, *Research Disclosure,* Vol. 228, No. 2287 (1983), U.S. Pat. Nos. 2,384,658, 2,403,721, 2,728,659, 2,735,765, 3,700,453, 2,675,314, 2,732,300, 2,360,290, etc., with Japanese Patent Application (OPI) Nos. 32034/78, 24141/83, 2128/71, 106329/74, 129535/74, 129536/74, 134327/74 110337/75, 9528/78, 55121/78, 29637/79 and 180557/84 corresponding to U.S. Pat. Nos. 4,198,239, 4,430,425, 3,700,453, 3,960,570, 3,935,016, 3,930,863 and 3,930,866, British Pat. No. 1,446,703, U.S. Pat. Nos. 4,121,939, 4,138,259, 4,179,293 and 4,587,210, respectively, and Japanese Patent Application (OPI) No. 153342/81 corresponding to U.S. Pat. Nos. 4,345,024 and 4,501,898 (divisional application).

Generally, however, these compounds are not known to overcome the above-described color restoration failure. Also, since hydroquinones cause color restoration failure when a bleach-fixing solution having a comparatively high pH and being adulterated with a color developer is used in combination therewith, their amounts are proposed to be decreased, as described in, for example, Japanese Patent Application (OPI) No. 60647/85.

SUMMARY OF THE INVENTION

The present invention has been made with the above-described background, and an object of the present invention is to provide an image forming process by which excellent image quality of a silver halide color photographic material is provided and so-called rapid processing, i.e., a silver halide color photographic material can be development-processed in a short time is provided.

Another object of the present invention is to provide an image forming process which improves color restoration failure of dye images formed from cyan couplers in a silver halide color photographic material and improves deterioration of image quality due to destruction of color balance of images of a silver halide color photographic material after processing.

These and other objects of the present invention will become apparent from the following description thereof.

As a result of intensive investigations, the inventors have found that the above-described and other objects of the present invention are attained by an image-forming process which comprises subjecting a multi-layer silver halide color photographic material containing, in an oil droplet dispersion in a light-sensitive layer provided on a support, at least one of the diffusion-resistant oil-soluble couplers capable of coupling with an oxidation product of an aromatic primary amine developing agent to form a substantially non-diffusible cyan dye represented by the following formula (I) and at lest one member selected from the compounds represented by the following formulae (II) and (III), to imagewise exposure and color development, and then processing said multi-layer silver halide color photographic material with a bleaching or bleach-fixing solution having a pH of 6.3 or less:

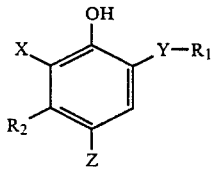

(I)

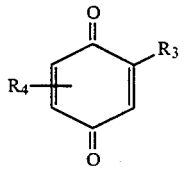

(II)

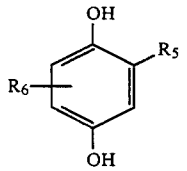

(III)

wherein:

Y represents -NHCO- or -CONH-;

$R_1$ represents an aliphatic group, an aromatic group, a heterocyclic group or an amino group;

X represents a hydrogen atom, a halogen atom, an aliphatic group, an alkoxy group or an acylamino group;

R represents an alkyl group or an acylamino group or, when bound to X, non-metallic atoms forming a 5- to 7-membered ring;

Z represents a hydrogen atom or a group capable of being eliminated upon coupling with an oxidation product of a developing agent; and $R_3$, $R_4$, $R_5$, and $R_6$ each represents a hydrogen atom, a chain, cyclic or branched alkyl or alkylthio group, provided that $R_3$ and $R_4$, or $R_5$ and $R_6$, do not represent hydrogen atoms at the same time and that, when they represent alkyl groups, those which are bound to the benzene ring via a tertiary carbon atom are excluded.

DETAILED DESCRIPTION OF THE INVENTION

In formula (I), $R_1$ represents a chain or cyclic aliphatic group containing preferably 1 to 32 carbon atoms (e.g., a methyl group, a butyl group, a pentadecyl group, a cyclohexyl group, etc.), an aromatic group (e.g., a phenyl group, a naphthyl group, etc.), a heterocyclic group (e.g., a 2-pyridyl group, a 3-pyridyl group, a 2-furanyl group, a 2-oxazolyl group, etc.) or a substituted amino group, which are preferably substituted by a substituent or substituents selected from an alkyl group, an aryl group, an alkyl- or aryl-oxy group (e.g., a methoxy group, a dodecyloxy groups a methoxyethoxy group, a phenyloxy group, a 2,4-di-tert-amylphenoxy group, a 3-tert-butyl-4-hydroxyphenyloxy group, a naphthyloxy group, etc.), a carboxy group, an alkyl- or aryl-carbonyl group (e.g., a acetyl group, a tetradecanoyl group, a benzoyl group, etc.), an alkyl- or aryl-oxycarbonyl group (e.g., a methoxycarbonyl group, a benzyloxycarbonyl group, a phenoxycarbonyl group, etc.), an acyloxy group (e.g., an acetyloxy group, a benzoyloxy group, a phenylcarbonyloxy group, etc.), a sulfamoyl group (e.g., an N-ethylsulfamoyl group, an N-octadecylsulfamoyl group, etc.), a carbamoyl group (e.g., an N-ethylcarbamoyl group, an N-methyl-dodecylcarbamoyl group, etc.), a sulfonamido group (e.g., a methanesulfonamido group, a benzenesulfonamido group, etc.), an acylamino group (e.g., an acetylamino group, a benzamido group, an ethoxycarbonylamino group, a phenylaminocarbonylamino group, etc.), an imido group (e.g., a succinimido group, a hydantoinyl group, etc.), a sulfonyl group (e.g., a methanesulfonyl group, etc.), a hydroxy group, a cyano group, a nitro group, and a halogen atom.

The term "aliphatic group" is intended to mean a straight, branched or cyclic aliphatic hydrocarbyl group, which may be saturated or unsaturated, including alkyl, alkenyl, and alkynyl groups.

In formula (I), $R_2$ represents an alkyl group containing 1 to 20 carbon atoms (e.g., a methyl group, an ethyl group, a butyl group, a pentadecyl group, etc.) or an acylamino group (e.g., a tetradecanoylamino group, a benzoylamino group, a 2-(2,4-di-tert-amylphenoxy)-butanamido group, etc.).

In formula (I), X represents a hydrogen atom, a halogen atom, an aliphatic group (e.g., a methyl group, a propyl group, an allyl group, etc.), an alkoxy group (e.g., a methoxy group, a butoxy group, etc.) or an acylamino group (e.g., an acetamido group).

As the compounds represented by formula (I), carbostyryl cyan couplers wherein $R_2$ and X are bound to each other to form a 5-, 6- or 7-membered ring are also favorable, as well as the aforesaid phenolic cyan couplers. Particularly preferable examples of such fused ring type couplers are hydroxyindole type and imidazol-2-one type cyan couplers.

In formula (I), Z represents a hydrogen atom or a coupling-off group which is exemplified by a halogen atom (e.g., a fluorine atom, a chlorine atom, a bromine atom, etc.), an alkoxy group (e.g., an ethoxy group, a dodecyloxy group, a methoxycarbamoylmethoxy group, a carboxypropyloxy group, a methylsulfonylethoxy group, etc.), an aryloxy group (e.g., a 4-chlorophenoxy group, a 4-methoxyphenoxy group, a 4-carboxyphenoxy group, etc.), an acyloxy group (e.g., an acetoxy group, a tetradecanoyloxy group, a benzoyloxy group, etc.), a sulfonyloxy group (e.g., a methanesulfonyloxy group, a toluenesulfonyloxy group, etc.), an amido group (e.g., a dichloroacetylamino group, a heptabutyrylamino group, a methanesulfonylamino group, a toluenesulfonylamino group, etc.), an alkoxycarbonyloxy group (e.g., an ethoxycarbonyloxy group, a benzyloxycarbonyloxy group, etc.), an aryloxycarbonyloxy group (e.g., a phenoxycarbonyloxy group, etc.), an aliphatic or aromatic thio group (e.g., an ethylthio group, a phenylthio group, a tetrazolylthio group, etc.), an imido group (e.g., a succinimido group, a hydantoinyl group, etc.), an N-containing heterocyclic group (e.g., a 1-pyrazolyl group, a 1-benzotriazolyl group, etc.), an aromatic azo group (e.g., a phenylazo group, etc.). These coupling-off groups may contain photographically useful groups.

The diffusion-resistant oil-soluble couplers represented by formula (I) may be a monomer or may form a dimer or a higher polymer (inclusive of an oligomer and a high molecular compound) through $R_1$, $R_2$, X or Z thereof. In case of the monomer, the total number of carbon atoms in each of $R_1$, X, $R_2$ and Z of the coupler represented by formula (I) is preferably up to 30.

In formulae (II) and (III), $R_3$, $R_4$, $R_5$, and $R_6$ each represents a hydrogen atom, an alkyl group preferably containing 4 or more carbon atoms (e.g., a butyl group, an octyl group, a pentadecyl group, an octadecyl group, etc., which may be chain, cyclic or branched, with the proviso that the carbon atom bound to the benzene ring is not tertiary) or an alkylthio group containing preferably 4 or more carbon atoms (e.g., an octylthio group, a dodecylthio group, etc.), provided that $R_3$ and $R_4$, or $R_5$ and $R_6$, do not represent hydrogen atoms at the same time.

The compounds represented by formulae (II) and (III) may be a monomer, a dimer, a trimer, a tetramer (tetrakis), an oligomer or a higher polymer, and in case of the monomer the total number of carbon atoms in each of $R_3$ and $R_4$ of the compound represented by formula (II), or in each of $R_5$ and $R_6$ of the compound represented by formula (III) is preferably up to 60.

In formula (I), $R_2$ preferably represents an alkyl group containing 1 to 15, more preferably 1 to 4, carbon atoms.

In formula (I), Z preferably represents a hydrogen atom or a halogen atom, particularly preferably a halogen atom.

In formula (I), X preferably represents a halogen atom.

In formulae (II) and (III), $R_3$, $R_4$, $R_5$, and $R_6$ preferably represent branched or chain alkyl groups containing 8 to 20 carbon atoms Of the compounds represented by formulae (II) and (III), quinone derivatives represented by formula (II) are particularly preferable.

$R_3$ and $R_4$ in formula (II) and $R_5$ and $R_6$ in formula (III) are preferably in the 2,5-substitution relation, respectively.

Specific examples of the compounds used in the present invention, and represented by formulae (I), (II), and (III), are illustrated below which, however, do not limit the present invention in any way.

(I-1)

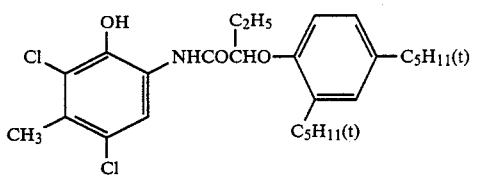

(I-2)

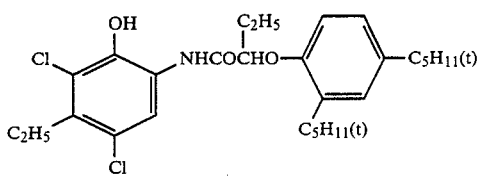

(I-3)

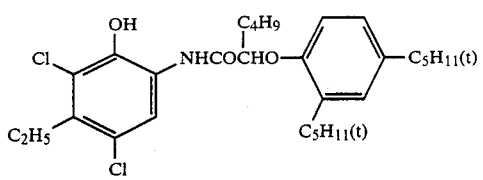

(I-4)

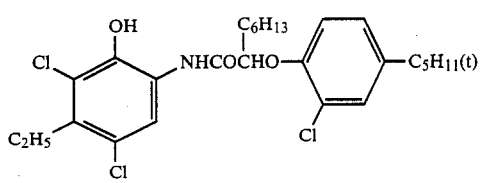

(I-5)

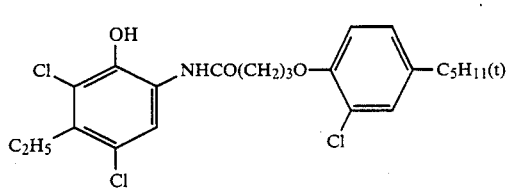

-continued
(I-6)
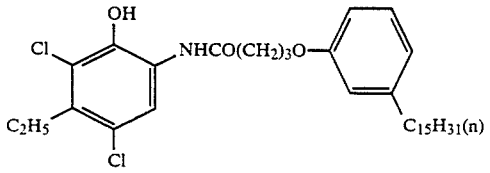
(I-7)
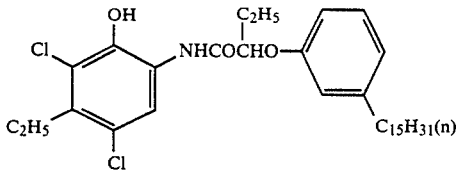
(I-8)
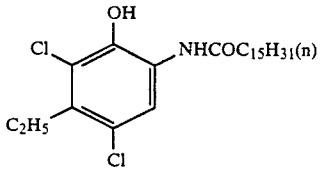
(I-9)
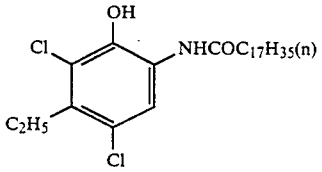
(I-10)
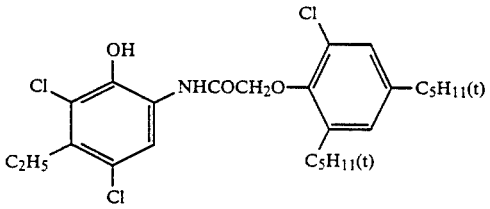
(I-11)
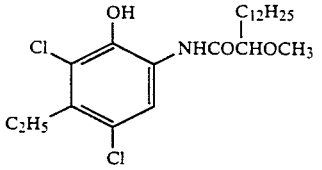
(I-12)
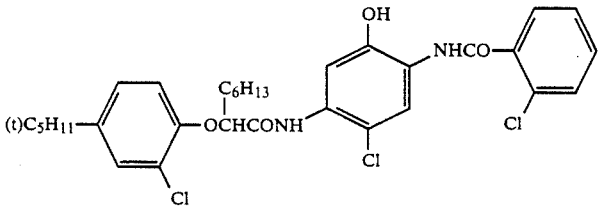
(I-13)
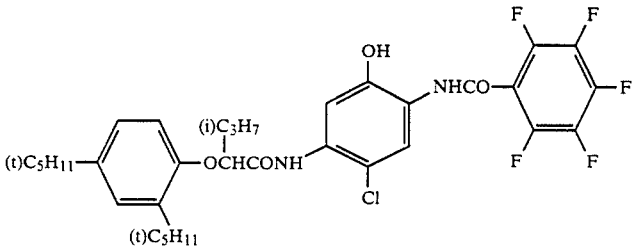

-continued
(I-14)
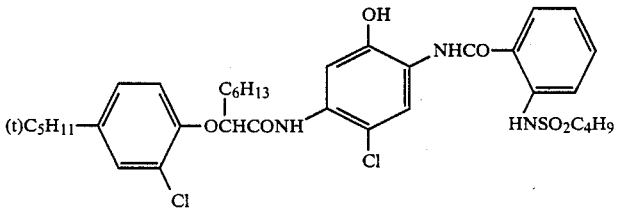
(I-15)
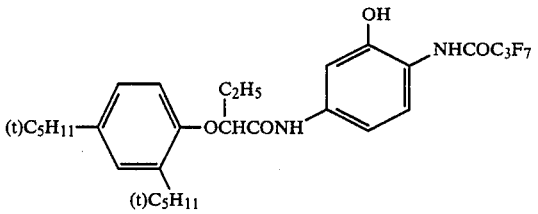
(I-16)
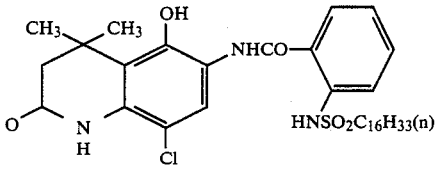
(I-17)
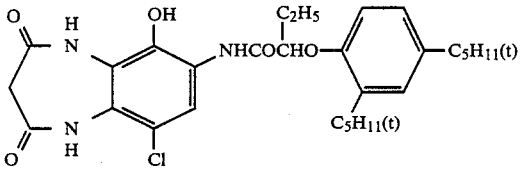
(I-18)
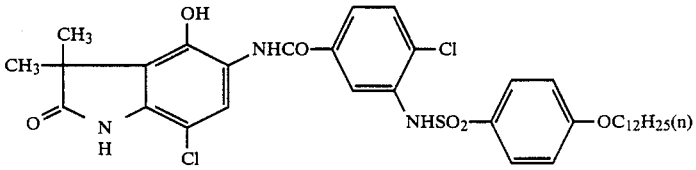
(I-19)
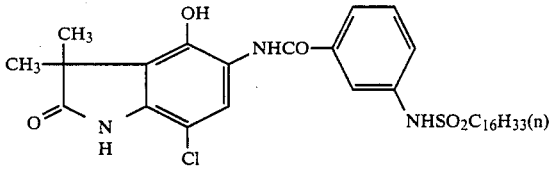
(I-20)
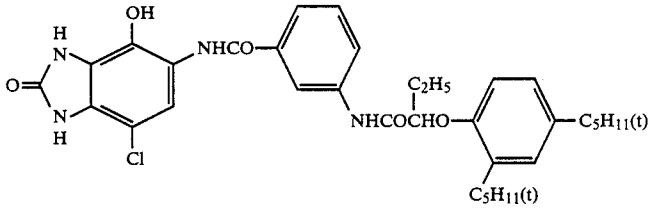
(I-21)
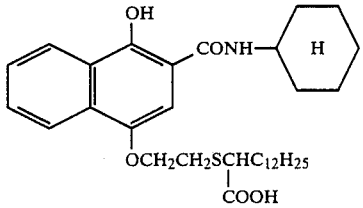

-continued
(I-22)
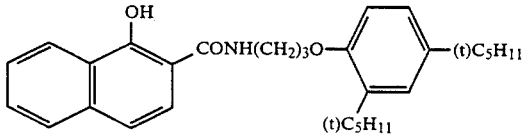
(I-23)
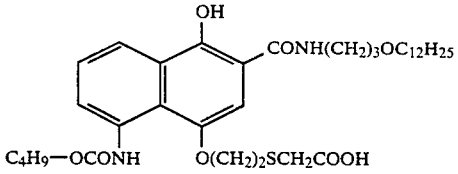
(I-24)
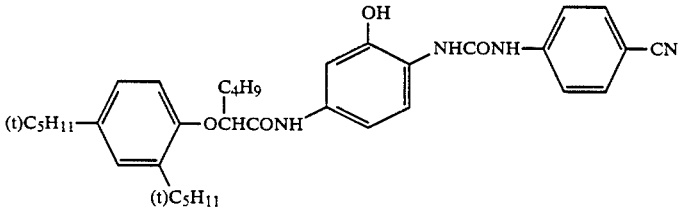
(II-1)
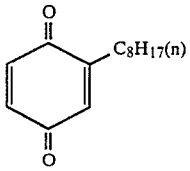
(II-2)
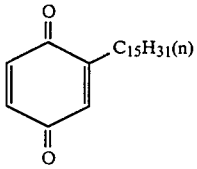
(II-3)
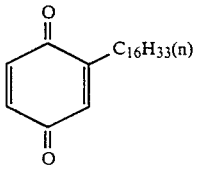
(II-4)
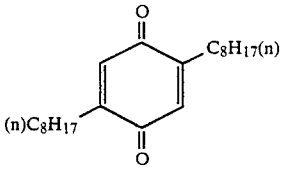
(II-5)
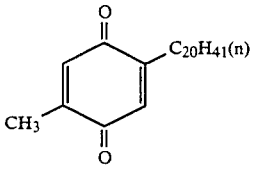
(II-6)
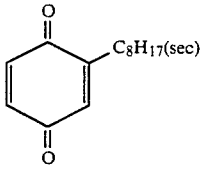

-continued
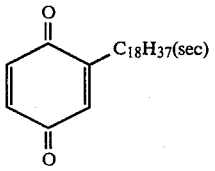
(II-7)
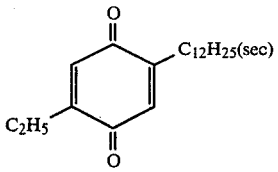
(II-8)
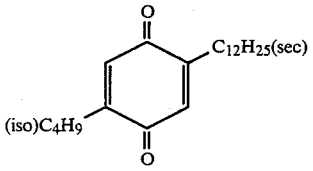
(II-9)
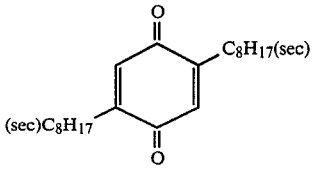
(II-10)
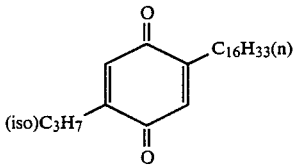
(II-11)
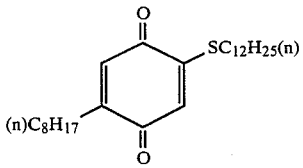
(II-12)
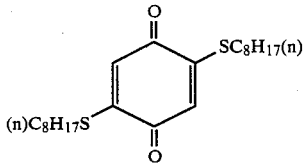
(II-13)
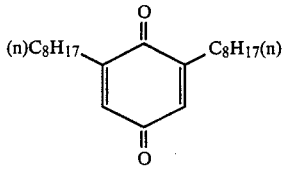
(II-14)
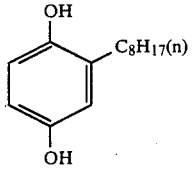
(III-1)

-continued
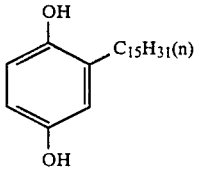
(III-2)
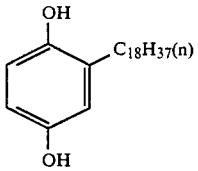
(III-3)
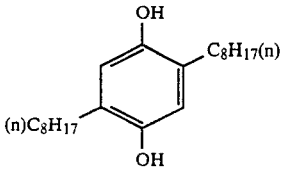
(III-4)
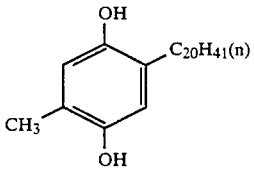
(III-5)
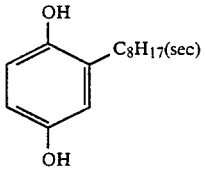
(III-6)
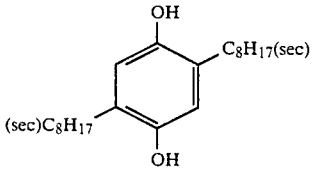
(III-7)
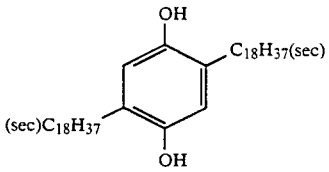
(III-8)
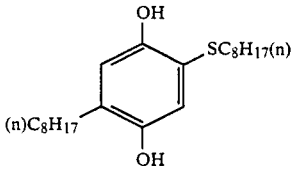
(III-9)
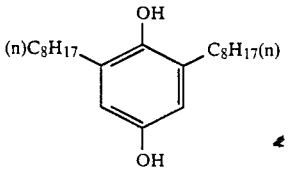
(III-10)

-continued (III-11)

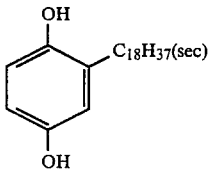

The cyan couplers used in the present invention represented by formula (I) are used in amounts of from 0.1 to 1 mol, preferably from 0.2 to 0.5 mol, per mol of silver halide in the light-sensitive silver halide emulsion layer into which they are introduced. The couplers used in the present invention may be introduced into light-sensitive layers according to processes known as oil-protecting processes. In this case, it is preferable to use a benzotriazole type ultraviolet ray absorbent described in U.S. Pat. No. 3,533,794, etc. or a substantially water-insoluble and organic solvent-soluble polymer in combination with the couplers of the present invention, for the purpose of improving preservability. In particular, the use of the latter type polymer is effective for overcoming dark-fading. Particularly useful examples thereof are compounds described in International Application No. PCT/JP87/00492, more specifically, compounds P-1 to P-158 described in pp. 14–33 of the specification.

Quinones used in the present invention and represented by formula (II), and/or hydroquinones used in the present invention and represented by formula (III), are used in amounts of from 0.1 to 100 mol %, preferably from 0 5 to 30 mol %, and more preferably from 1 to 20 mol %, per mol of the cyan coupler, represented by formula (I). The present invention may be applied to any processing system for light-sensitive materials using the system as described above. In the case of using the compound of formula (II) together with the compound of formula (I), the ratios of these two compounds used may freely be selected, but the molar ratio of the compound of the formula (II) to the compound of the formula (I) is preferably 1/100 to 10 times.

The use of the specific hydroquinone and/or quinone according to the present invention is particularly effective when a bleaching solution or a bleach-fixing solution is adulterated with a developing agent (having been brought from a pre-bath).

The light-sensitive material to be processed according to the present invention preferably contains a layer containing a color mixing-preventing agent or an ultraviolet ray absorbent, a gelatin layer or the like as an interlayer in addition to the emulsion layers of a red-sensitive layer, a green-sensitive layer, and a blue-sensitive layer. The color mixing-preventing agent is preferably incorporated in an interlayer, a protective layer, a subbing layer, etc. The ultraviolet ray absorbent is preferably incorporated in an interlayer, a protective layer, a subbing layer, etc. The color mixing-preventing agent and the ultraviolet ray absorbent may be incorporated either in the same layer or in the different layer. In addition, a matting agent is preferably incorporated in the uppermost protective layer for the purpose of preventing the generation of static charges, preventing adhesion, and protecting the surface. The size of the matting agent is 0.1$\mu$ to 30$\mu$, which is properly selected as the case demands.

In the present invention, 5-pyrazolones, pyrazoloazoles, pyrazolobenzotriazoles, and cyanoacetyls, may be used as magenta couplers, and pivaloylacetanilides and benzoylacetanilides, may be used as yellow couplers. Of these, 3-anilino-5-pyrazolones and pyrazolotriazoles are preferable as magenta couplers, and $\alpha$-pivaloylacetanilides are preferable as yellow couplers. In particular, couplers represented by the following formulae (IV) to (VI) are advantageous. Formula (IV)

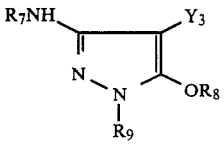

Formula (IV)

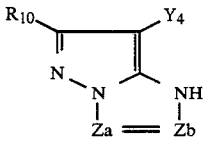

Formula (V)

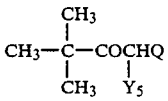

Formula (VI)

In the above formulae, $R_7$ and $R_9$ each represents a substituted or unsubstituted phenyl group, $R_8$ represents a hydrogen atom, an aliphatic or aromatic acyl group or an aliphatic or aromatic sulfonyl group, $R_{10}$ represents a hydrogen atom or a substituent, Q represents a substituted or unsubstituted N-phenylcarbamoyl group, $Z_a$ and $Z_b$ each represents a methine group, a substituted methine group or =N—, and $Y_3$, $Y_4$, and $Y_5$ each represents a hydrogen atom or a group capable of being eliminated upon coupling reaction with an oxidation product of a developing agent (hereinafter abbreviated as "coupling-off group").

Further, polymers having a polymerization degree of two or more may be formed via $R_7$, $R_8$, $R_9$ or $Y_3$; $R_{10}$, $Z_a$, $Z_b$ or $Y_4$; or Q or $Y_5$.

Of the couplers represented by the above-described formulae, magenta couplers represented by formula (V) and yellow couplers represented by formula (VI) are particularly useful.

At least one of so-called ballast groups is preferably contained in each coupler as $R_7$, $R_8$, $R_9$, and $Y_3$ in formula (IV), $R_{10}$ and $Y_4$ in formula (V), Q and $Y_5$ in formula (VI), or a substituent for them, or a substituent for $Z_a$ and $Z_b$ in formula (V).

Specific examples of the ballast group are illustrated in the following patent specifications: Japanese Patent Publication Nos. 23902/67 and 3660/69, Japanese Patent Application (OPI) No. 19435/75, Japanese Patent Publication No. 46384/84, Japanese Patent Application (OPI) Nos. 45442/84, 174836/84, 177553/84, 177554/84, 177555/84, 177556/84, 177557/84, 41042/85, 55340/85, 185951/85, U.S. Pat. Nos. 2,688,544, 2,698,795, 2,772,161, 2,908,573, 2,895,826, 2,920,961, 3,519,429, Japanese Patent Application (OPI) No. 37636/72, U.S. Pat. Nos. 4,124,396, 4,443,536, Japanese Patent Publication Nos. 22900/68, 29417/68, 6992/69, 41474/70, 19025/71, 19026/71, 19032/71, 25932/73, 16056/74, Japanese Patent Application (OPI) Nos. 29639/74, 53437/74, 134644/75, 76834/78, 82411/78, 141622/78, 7702/80, 93153/80, 30126/81, 124341/84, U.S. Pat. Nos. 2,186,719, 3,488,193, Japanese Patent Application (OPI) Nos. 4481/72, 8228/74, 110344/74, 20723/75, West German Patent Application (OLS) No. 2,707,488, U.S. Pat. No. 4,458,011, French Pat. No. 1,202,940, U.S. Pat. Nos. 3,133,815, 3,161,512, 3,183,095, Japanese Patent Publication No. 16190/68, U.S. Pat. Nos. 3,547,944, 3,285,747, British Pat. No. 1,128,037, Japanese Patent Publication No. 9314/72, Japanese Patent Application (OPI) Nos. 71640/73, 48922/75, 126831/76, 47728/77, 119323/77, 38599/80, etc.

Preferable specific examples of the couplers represented by formulae (IV) to (V) are illustrated below:

(M-1)

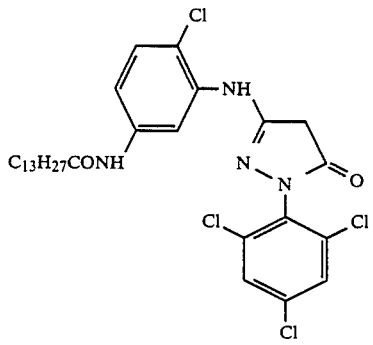

(M-2)

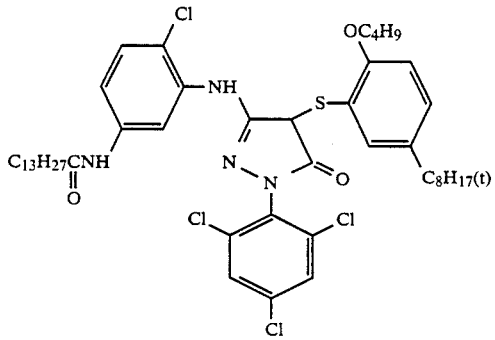

(M-3)

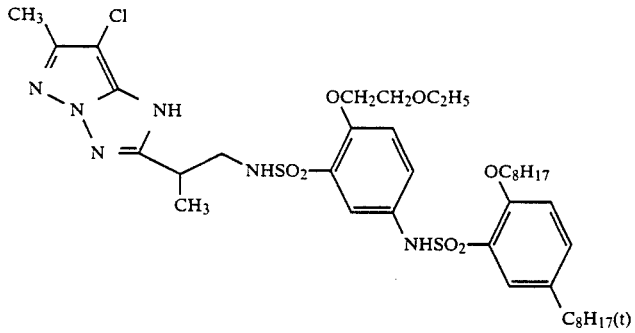

(M-4)

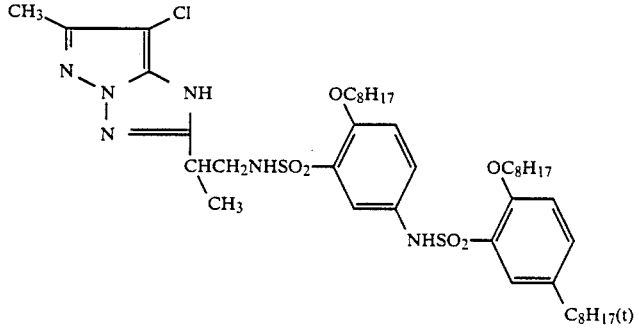

-continued
(M-5)
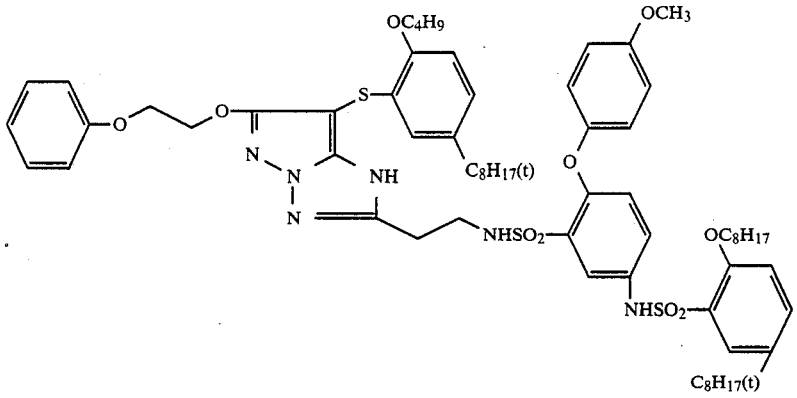
Preferable specific examples of the coupler represented formula (VI) are illustrated below:
(Y-1)
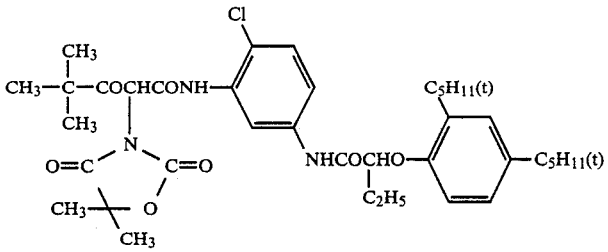
(Y-2)
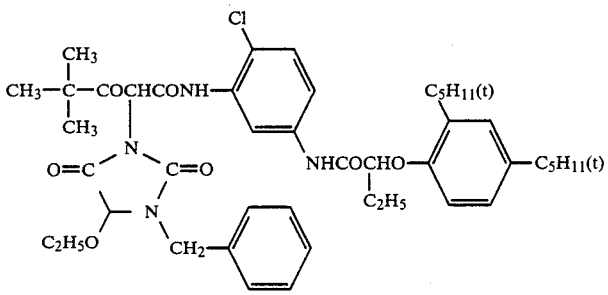
(Y-3)
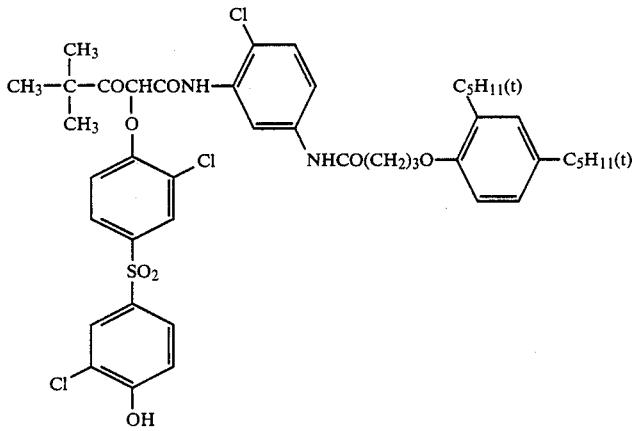

-continued
(Y-4)
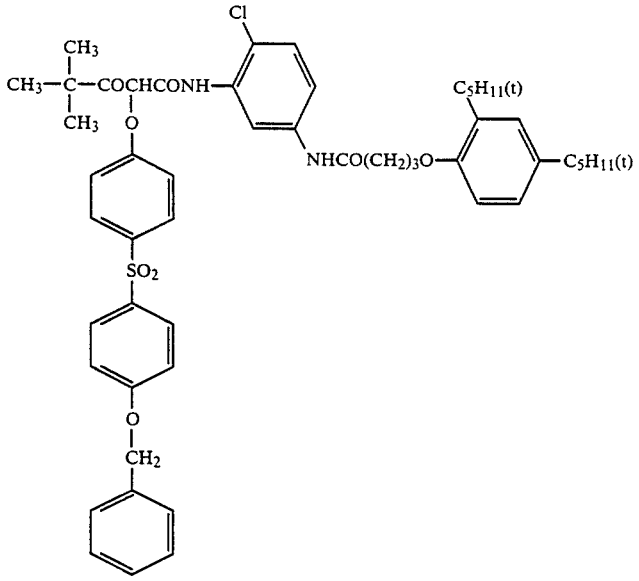
(Y-5)
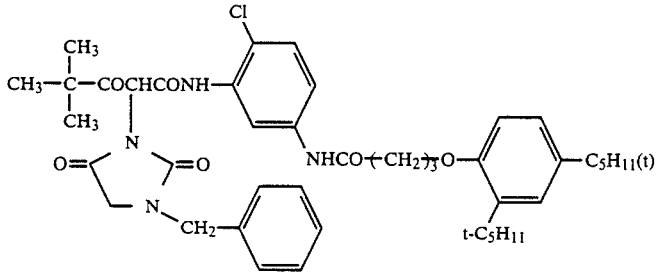
(Y-6)
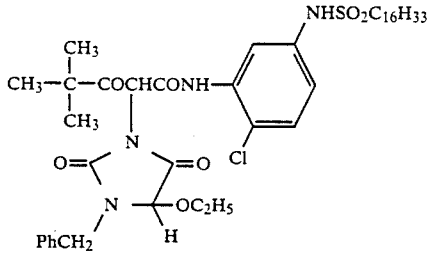
(Y-7)
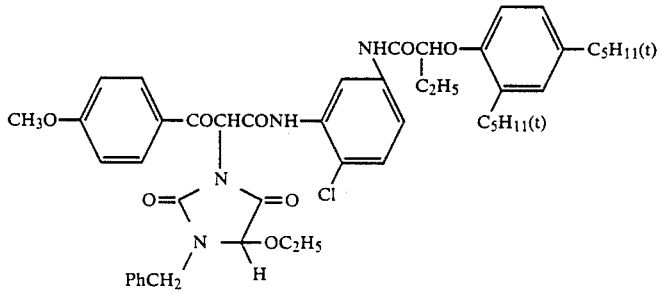

-continued (Y-8)

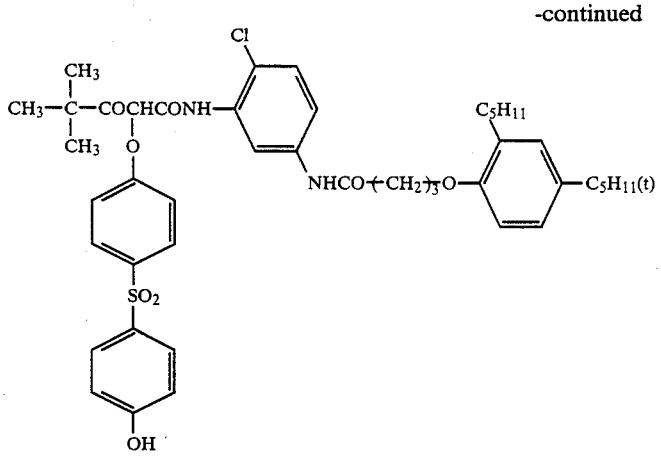

(Y-9)

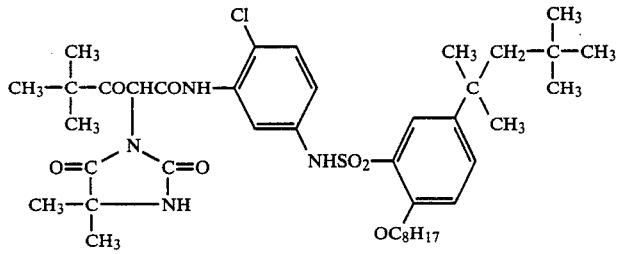

Ultraviolet ray absorbents may be incorporated in the second interlayer for improving the light-resistance of dye images formed from respective couplers and/or in a protective layer for improving heat resistance.

As such ultraviolet ray absorbents, 2-(2'-hydroxyphenyl)benzotriazole compounds and benzophenone compounds are known. The former include those which are solid or liquid at ordinary temperatures, for example, those described in Japanese Patent Publication Nos. 36984/80 and 12587/80, Japanese Patent Application (OPI) Nos. 214152/83, 221844/83, 46646/84, and 109055/84, Japanese Patent Publication Nos. 10466/61, 26187/67, 5496/73, 41572/73, U.S. Pat. Nos. 3,754,919, 4,220,711, etc. It is known to add one, two, or more of these couplers to a protective layer and/or a second interlayer.

Japanese Patent Publication Nos. 31255/73 and 30493/73 describe the use of a benzophenone type ultraviolet ray absorbent and a benzotriazole type ultraviolet ray absorbent in combination. British Pat. No. 2,016,017A discloses impregnating polymer latex with an ultraviolet ray absorbent. In order to improve the stability (particularly to light) of the ultraviolet ray absorbents themselves, they are preferably dispersed together with a polymer such as vinyl polymer or polyester resin.

In introducing the cyan couplers used in the present invention or magenta and yellow couplers to be used together into emulsion layers, they are preferably dissolved in a high-boiling organic solvent having a boiling point of 160° C. or more, such as an alkyl phthalate (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azelate, etc.), a phenol (e.g., 2,4-di-(t)-amylphenol, etc.), etc., and a low-boiling organic solvent having a boiling point of 30° to 150° C. such as a lower alkyl acetate (e.g., ethyl acetate, butyl acetate, etc.), ethyl propionate, sec-butyl alcohol, methyl isobutyl ketone, β-ethoxyethyl acetate, methylcellosolve acetate, etc., alone or in combination as the occasion demands, with the resulting solution being previously emulsified and dispersed in a hydrophilic colloid.

Special couplers other than the couplers represented by the foregoing formulae may also be incorporated in the light-sensitive material used in the present invention. For example, colored magenta couplers may be incorporated in a green-sensitive emulsion layer to attain masking effect. Development inhibitor-releasing couplers (DIR couplers), development inhibitor-releasing hydroquinones, etc., may also be incorporated in the respective color-sensitive emulsion layers of the adjacent layers thereof. The development inhibitors which are released from these compounds upon development give interimage effects of improving image sharpness, forming fine-grained images, or improving monochromatic saturation.

Couplers capable of releasing a development accelerator or a nucleating agent upon development of silver halide may be added to the photographic emulsion layer used in the present invention or adjacent layers thereto, to obtain the effects of improving photographic sensitivity, improving graininess of color image, or providing high gradation.

In order to improve the preservability of colored dye images, particularly yellow and magenta images, various organic and metal complex-type cloy fading-preventing agents may be used. The organic color fading-preventing agents include hydroquinones, gallic acid derivatives, p-alkoxyphenols, p-hydroxyphenols, etc. *Research Disclosure,* RD No. 17643 (December, 1978), Item VII, I to J, cites patents relating to dye stabilizers, stain-preventing agents or antioxidants. The metal complex type color fading-preventing agents are described in *Research Disclosure*, RD No. 15162 (November, 1976), etc.

In order to improve the fastness of yellow images to heat and light, many compounds belonging to phenols, hydroquinones, hydroxychromans, hydroxycoumarans, hindered amines, alkyl ethers, silyl ethers or hydrolizable precursor derivatives thereof, may be used.

As a binder or protective colloid for use in the photographic emulsions, gelatin is advantageously used. However, other hydrophilic colloids may be used as well.

For example, proteins (such as gelatin derivatives, graft polymers between gelatin and other high polymers, albumin, casein, etc.), cellulose derivatives (such as hydroxyethylcellulose, carboxymethylcellulose, cellulose sulfate, etc.), sugar derivatives (such as sodium alginate, starch derivatives, etc.), and various synthetic hydrophilic macromolecular substances (such as homopolymers or copolymers (e.g., polyvinyl alcohol, partially acetallized polyvinyl alcohol, poly-N-vinyl pyrrolidone, polyacrylic acid, polymethacrylic acid, polyacrylamide, polyvinyl imidazole, polyvinyl pyrazole, etc.)), may be used.

As the gelatin employed, acid-processed gelatin or enzyme-processed gelatin, as described in *Bull. Soc. Sci. Photo. Japan*, No. 16, p. 30 (1966) may be used as well as lime-processed gelatin, and a gelatin hydrolyzate or an enzyme-decomposed product, may also be used.

The light-sensitive materials used in the present invention may contain, in its photographic emulsion layer or other hydrophilic colloid layer, brightening agents such as stilbene type, triazine type, oxazole type or coumarin type whitening agents. These may be water-soluble or water-insoluble, with the latter being used in the form of dispersion. Specific examples of brightening agents are described in U.S. Pat. Nos. 2,632,701, 3,269,840, 3,359,102, British Pat. Nos. 852,075, 1,319,763, *Research Disclosure*, Vol. 176, RD No. 17643 (December, 1978), p. 24, left column, lines 9 to 36, giving a description of brighteners, and the like.

In the case of incorporating dyes, ultraviolet ray absorbents, etc., in the hydrophilic colloidal layers of the light-sensitive material used in the present invention, these compounds may be mordanted with a cationic polymer, etc. For example, the polymers described in British Pat. No. 685,475, U.S. Pat. Nos. 2,675,316, 2,839,401, 2,882,156, 3,048,487, 3,184,309, 3,445,231, West German Patent Application (OLS) No. 1,914,362, Japanese Patent Application (OPI) Nos. 47624/75, 71332/75, etc., may be used.

The light-sensitive material used in the present invention may contain hydroquinone derivatives, aminophenol derivatives, gallic acid derivatives, ascorbic acid derivatives, etc., as color fog-preventing agents. Specific examples thereof, are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77, Japanese Patent Publication No. 23813/75, etc In addition to the above-described ingredients, various additives known in the art such as stabilizers, antifoggants, surfactants, couplers (other than those represented by formula (I)), filter dyes, irradiation-preventing dyes, and developing agents may be added to the color photographic material used in the present invention as the case demands. Examples thereof are described in *Research Disclosure*, RD No. 17643 (December, 1978).

Further, in some cases, substantially light-insensitive fine-grain silver halide emulsions (for example, a silver chloride emulsion, a silver bromide emulsion or a silver chlorobromide emulsion having average grain size of up to 0.20μ) may be added to silver halide emulsion layers or other hydrophilic colloidal layers.

Formed dyes are deteriorated and faded by fungi as well as by light, heat, and humidity during storage. Since cyan color images are particularly seriously deteriorated by fungi, the use of antifungal agents is preferred. Specific examples of the antifungal agents include 2-thiazolylbenzimidazoles, as described in Japanese Patent Application (OPI) No. 157244/82. The antifungal agents may be incorporated in the light-sensitive materials, may be added thereto from outside in the development-processing step, or may be added in any step by allowing to coexist with processed light-sensitive materials.

In the light-sensitive materials used in the present invention, color mixing-preventing agents may be added to an interlayer or an ultraviolet ray-absorbing layer provided between layers having different color sensitivities from each other.

As the color mixing-preventing agents to be used in the present invention, there are various reducing agents including hydroquinones. The most typical being alkylhydroquinones. As to the use of such compounds as color mixing-preventing agents in the interlayer, U.S. Pat. Nos. 2,360,290, 2,419,613, 2,403,721, 3,960,570, 3,700,453, Japanese Patent Application (OPI) Nos. 106329/74 and 156438/76, etc., describe monoalkyl-substituted hydroquinones, and U.S. Pat. Nos. 2,728,659, 2,732,300, 3,243,294, 3,700,453, Japanese Patent Application (OPI) Nos. 156438/75, 9528/78, 55121/78, 29637/79, 55339/85, etc., described dialkyl-substituted hydroquinones.

As hydroquinones derivatives capable of being incorporated in the protective layer or the interlayer of the photographic light-sensitive material used in the present invention, there are the compounds represented by the following formulae (HQ-I), (HQ-II) and (RD-I):

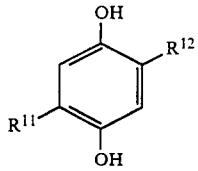

(HQ-I)

wherein $R^{11}$ and $R^{12}$ each represents a hydrogen atom or a substituted or unsubstituted alkyl group (containing 1 to 60 carbon atoms; such as a methyl group, a (t)-butyl group, a (n)-octyl group, a (sec)-octyl group, a (t)-octyl group, a (sec)-dodecyl group, a (t)-pentadecyl group, a (sec)-octadecyl group, etc.), with one of $R^{11}$ and $R^{12}$ being an alkyl group.

The compounds represented by formula (HQ-I) may be a monomer, a dimer, a trimer, a tetramer (tetrakis), an oligomer or a higher polymer, and in case of the monomer the total number of carbon atoms in each of $R_{11}$ and $R^{12}$ of the compound presented by formula (HQ-I) is preferably up to 60.

Hydroquinone sulfonates are also preferably used as color mixing-preventing agents as described in U.S. Pat. No. 2,701,197, Japanese Patent Application (OPI) No.

172040/85, etc. Hydroquinonesulfonates to be preferably used as the color mixing-preventing agents which can be used in the present invention are those represented by the following formula:

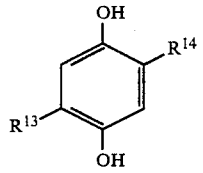
(HQ-II)

wherein $R^{13}$ represents a substituted or unsubstituted alkyl, alkylthio, amido or alkyloxy group, and $R^{14}$ represents a sulfo group or a sulfoalkyl group (e.g., a sulfopropyl group).

The compounds represented by the formula (HQ-II) may be a monomer, a dimer, a trimer, a tetramer (tetrakis), an oligomer or a higher polymer, and in case of the monomer the total number of carbon atoms in each of $R^{13}$ and $R^{14}$ of the compound represented by formula (HQ-II) is preferably up to 60.

Amidohydroquinones are also preferably used as color mixing-preventing agents, which are described in Japanese Patent Application (OPI) No. 202465/84, Japanese Patent Application Nos. 165511/85, and 296088/85 (corresponding to Japanese Patent Application (OPI) Nos. 103638/87 and 150346 87, respectively), etc. Amidohydroquinones, which can be preferably used in the present invention as color mixing-preventing agents, are those which are represented by the following formula:

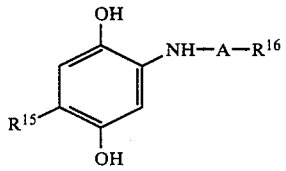
(RD-I)

wherein $R^{15}$ represents a hydrogen atom, a halogen atom or a substituted or unsubstituted alkyl group, A represents

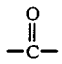

or $—SO_2—$, and $R^{16}$ represents a substituted or unsubstituted alkyl or aryl group.

The compounds represented by the formula (RD-I) may be a monomer, a dimer, a trimer, a tetramer (tetrakis), an oligomer or a higher polymer, and in case of the monomer the total number of carbon atoms in each of $R^{15}$ and $R^{16}$ of the compound represented by formula (RD-I) is preferably up to 60.

In addition to the above-described alkylhydroquinones, hydroquinonesulfonates, and amidohydroquinones, those hydroquinones which have electron-attractive substituents, such as described in Japanese Patent Application (OPI) Nos. 43521/80, 109344/81, 2237/82, etc., may also be preferably used as color mixing-preventing agents. Specific examples of hydroquinones preferable as color mixing-preventing agents are described below:

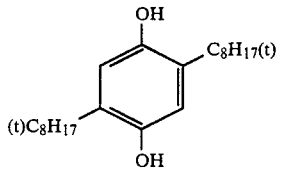
(HQ-1)

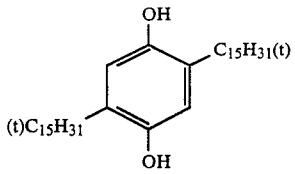
(HQ-2)

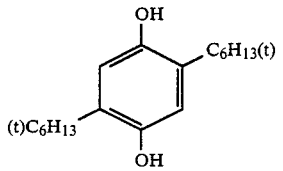
(HQ-3)

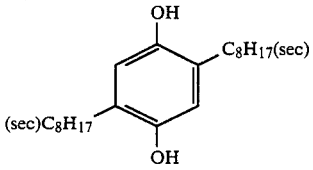
(HQ-4)

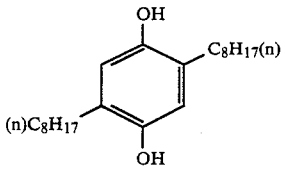
(HQ-5)

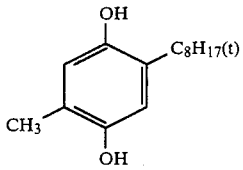
(HQ-6)

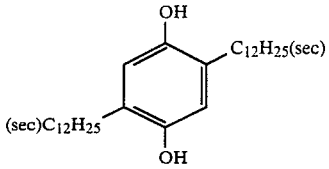
(HQ-7)

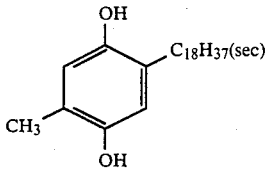
(HQ-8)

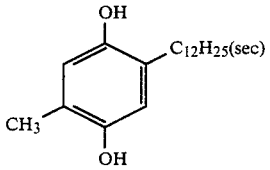
(HQ-9)

-continued
(HQ-10)
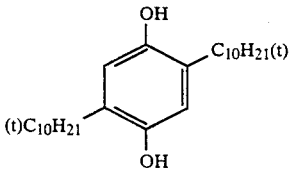
(HQ-11)
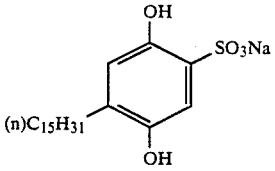
(HQ-12)
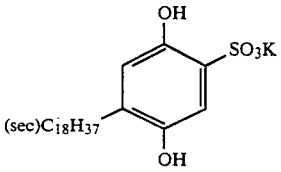
(HQ-13)
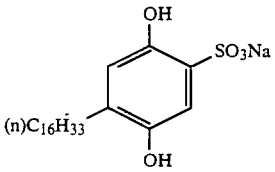
(HQ-14)
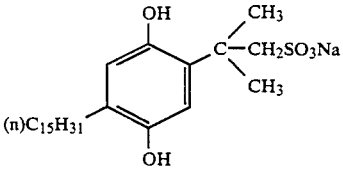
(HQ-15)
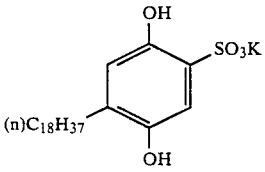
(HQ-16)
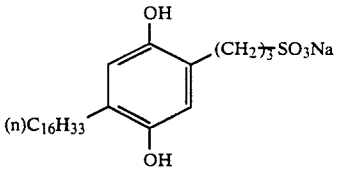
(HQ-17)
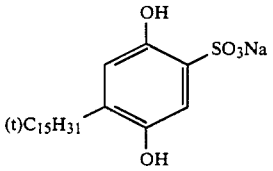
(HQ-18)
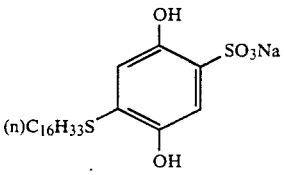
-continued
(HQ-19)
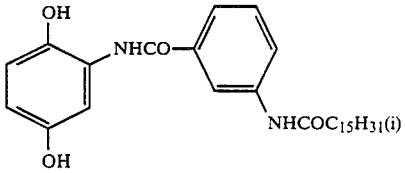
(HQ-20)
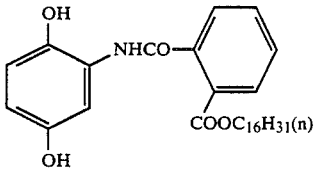
(HQ-21)
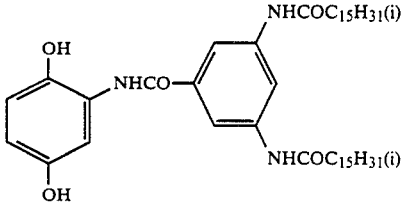
(HQ-22)
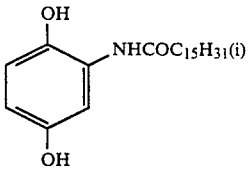
(HQ-23)
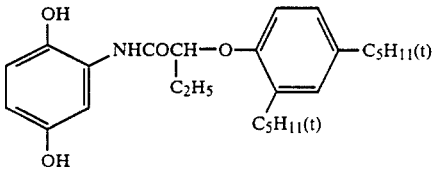
(HQ-24)
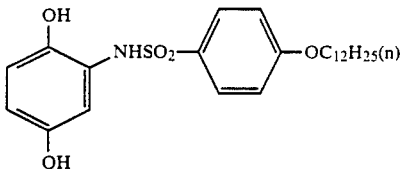
(HQ-25)
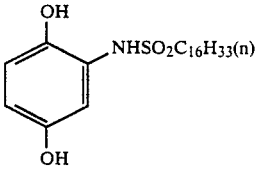
(HQ-26)
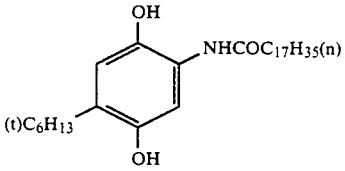

-continued (HQ-27)

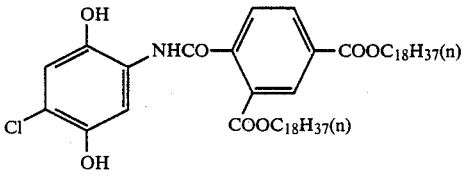

(HQ-28)

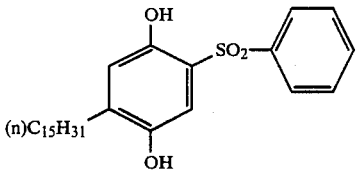

(HQ-29)

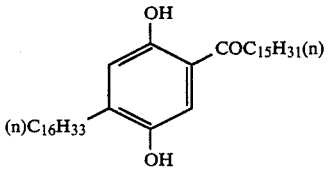

(HQ-30)

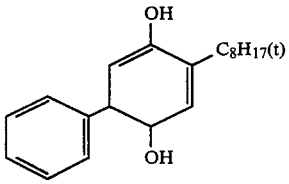

(HQ-31)

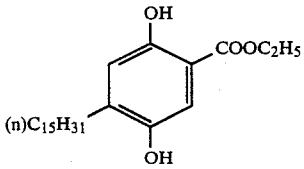

(HQ-32)

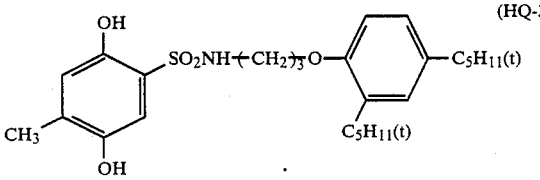

(HQ-33)

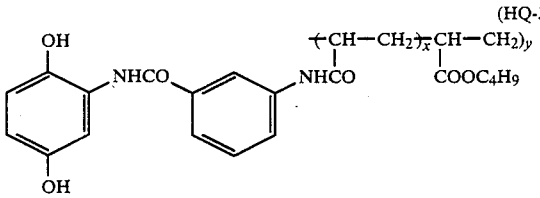

x:y = 2:5 Average molecular weight: about 20,000

(HQ-34)

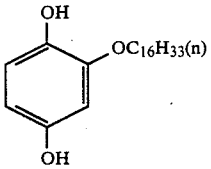

Reducing agents having a skeleton other than a hydroquinone skeleton may also be used as color mixing-preventing agents. For example, there may be used the gallic acid amides described in Japanese Patent Application (OPI) No. 156933/83 and sulfonamidophenols described in Japanese Patent Application (OPI) Nos. 5247/84 and 202465/84. Specific examples thereof are illustrated below.

(RD-1)

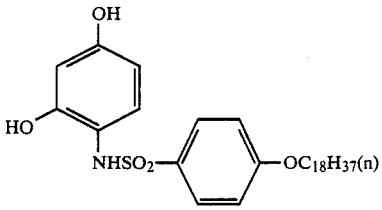

(RD-2)

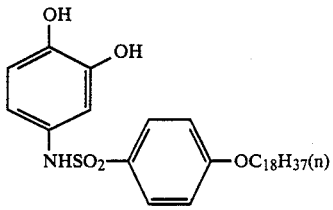

(RD-3)

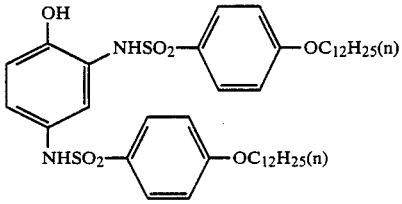

(RD-4)

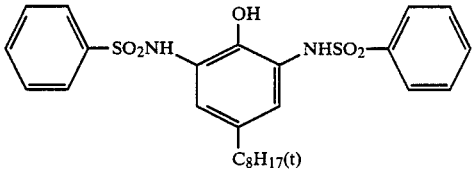

(RD-5)

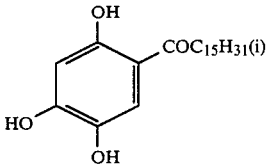

(RD-6)

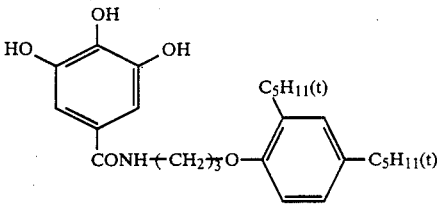

(RD-7)

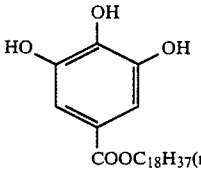

(RD-8)

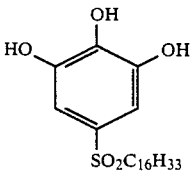

-continued

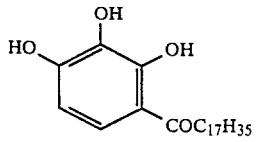

(RD-9)

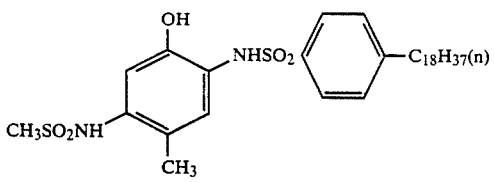

(RD-10)

The silver halide emulsions to be used in the present invention may be any of silver chloride, silver bromide, and silver iodide, with silver chlorobromide containing substantially no silver iodide, being particularly preferable.

The phrase "containing substantially no silver iodide" means that the content of silver iodide based on the entire silver halide amount is up to 3 mol %, preferably up to 1 mole %, more preferably up to 0.5 mol %, most preferably 0. Incorporation of silver iodide is advantageous with respect to photosensitivity, that is, it increases the amount of light absorption, strengthens adsorption of spectrally sensitizing dyes, or weakens desensitization by spectrally sensitizing dyes. Hence, in some cases, the incorporation of silver iodide in a slight amount, for example, up to 1 mol %, particularly up to 0.2 mol % is more preferable than the incorporation of no silver iodide. However, in such cases, silver iodide itself delays the development of grains in which it is contained in comparison with silver chloride or silver bromide. Therefore, in the present invention, silver iodide-free silver halide emulsions are fundamentally preferred but, in the case where the above-described advantages are obtained, the incorporation of a slight amount of silver iodide may be advantageous.

In the case of using silver chlorobromide in the present invention, any halide composition ratio may be employed, and pure silver chloride, pure silver bromide, and a mixture thereof, may be employed. They may contain a slight amount of silver iodide as described above.

A silver chlorobromide emulsion containing 10 mol % or more silver bromide is preferably used in the present invention. In order to obtain emulsions with sufficient sensitivity and without increased fog, the content of silver bromide is preferably not less than 20 mol %. However, in the case that rapid developing properties are required, the silver bromide content is in some cases preferably up to 20 mol %, more preferably up to 10 mol %.

When rapid developing properties are particularly required in the image-forming process of the present invention, the use of silver chloride containing up to 3 mol %, more preferably up to 1 mol % silver bromide (i.e., substantially silver bromide-free) is more preferred.

Reduction in the content of silver bromide is favorable not only because rapid developing properties are improved but because, where light-sensitive materials containing such silver halide are running-processed with a processing solution, the concentration of bromide ion accumulated in equilibrium in the developer and decided with relation between the amount of bromide ion eluted from the light-sensitive materials during the processing and the replenishing amount of developer is at a low level, rapid developing properties of the developer itself may be set at a high level.

In order to obtain light-sensitive materials which scarcely form fog and which show stable gradation in the image-forming process of the present invention, a higher silver bromide content is desirable, with a silver bromide content of 50 mol % or more being preferred. Further, a silver bromide content of 65 mol % or more gives an extremely stable emulsion, thus being preferable. When the content of silver bromide exceeds 95 mol %, slightly decreased rapid developing properties result which, however, is not affected by changing the form of crystal grains (e.g., tabular grains, etc.) or by using a development accelerator (e.g., a 3-pyrazolidone, a thioether, a hydrazine, etc.), and light-sensitive materials having high sensitivity and showing good preservability and processability can be obtained.

Developability of silver halide grains is decided not only by the halide composition of total grains, but by the halide distribution within the grains. Therefore, in the present invention, silver halide emulsions may have a distribution or a structure within grains with respect to halide composition. Typical examples thereof, are core-shell type or double-structure type grains wherein the inner portion and the surface layer are different from each other with regard to halide composition. In such grains, the form of core and that of shelled core may be the same or different. Specifically, cubic cores may be shelled to form cubic grains or octahedral grains. On the contrary, octahedral cores may be shelled to form cubic grains or octahedral grains. In some cases, cores are in a distinct regular form, whereas shelled grains are somewhat out of shape or in an irregular form. In addition, triple-layered or more multi-layered structures or core-shell double-structures having a thin silver halide layer with a different halide composition formed on the surface thereof may be employed as well as a mere double structure.

In forming a structure within grains, grains having a so-called conjunction structure may also be prepared, as well as the above-described surrounding structure.

Conjunction-making crystals having a halide composition different from host crystals may make conjunction to the edge, corner, or plane of the host crystals. Such conjunction crystals may have a structure wherein the host crystals are uniform with respect to halide composition or possess the core-shell type structure. Grains of the above-described structures may be, for example, core-shell type grains wherein the core portion contains a higher content of silver bromide than the shell portion or, reversely, the core portion contains a lower content of silver bromide than the shell portion. Likewise, grains of the conjunction structure may be grains wherein the host crystals contain a higher content of silver bromide than the conjunction-making crystals or, reversely, the host crystals contain a lower content of silver bromide than the conjunction-making crystals.

In the grains of the above-described structure, the boundary between portions different from each other in halide composition may be a distinct boundary, may be an indistinct boundary forming crystals owing to composition difference, or may be positively established continuously changing structure.

In the present invention, emulsions containing grains having some structure (i.e., core-shell, conjunction type, etc.) are more preferably used than those containing grains which have an uniform halide composition. Grains containing silver bromide in a lower content in the surface than in the inner portion are more preferably used. Typical examples thereof are core-shell type emulsions containing grains wherein the core portion contains a higher content of silver bromide than the shell portion. The molar ratio of the core portion of the shell portion may be freely selected between 0:100 to 100:0 but, in order to discriminate from grains of uniform structure, the ratio be preferably between 3:97 to 98:2.

In forming the shell portion by so-called halide conversion, utilizing the solubility difference of silver halides depending upon the kind of halide, particularly in forming the shell portion by halide-converting silver chloride with a water-soluble bromide, the ratio is preferably less than 98:2, more preferably 99:1 or less. However, it is difficult to uniformly cover the grain surface by the shell formed by the halide conversion technique, and the shell portion is liable to adhere to corners or edges of grains. Such halide-converted grains gradually become uniform with respect to halide distribution by, for example, Ostwald ripening. In the present invention, both of such grains wherein the halide distribution is becoming uniform and grains in the form immediately after the halide conversion may be preferably used.

In using core-shell type silver halide grains in the image-forming process of the present invention, the core/shell ratio is preferably between 5:95 to 95:5, more preferably 7:93 to 90:10, and most preferably 15:85 to 80:20.

The difference in silver bromide content between the core portion and the shell portion varies depending upon the constitutional mol ratio of the core portion to the shell portion, but is preferably from 3 mol % to 95 mol %, more preferably from 5 mol % to 80 mol %, and most preferably from 10 mol % to 70 mol %. If the difference in silver bromide content between the core portion and the shell portion is small, core/shell type grains are not so different from those of uniform structure, whereas if the difference is too large, problems with photographic properties are liable to arise. Thus, such grains are not preferable. Proper composition difference depends upon core/shell constitutional ratio and, it is preferred that, the nearer the constitutional ratio to 0:100 or 100:0, the larger the difference and, the nearer the constitutional ratio to 1:1, the smaller the difference.

Silver chlorobromide grains to be used in the present invention may be in a tetradecahedral form, a rhombic dodecahedral form, or any other form in addition to the cubic or octahedral form described hereinbefore. Particularly with conjunction type grains, grains in a regular form, wherein conjunction-making crystals are uniformly produced at corners or edges or on planes of host crystals, may be used. The grains may be spherical. In the present invention, octahedral grains are preferably used, cubic grains being particularly preferably used. Tabular grains may also be used, and emulsions wherein tabular grains of 5 to 8 in ratio of grain diameter (converted as disc form) to grain thickness account for 50 mol % or more of the projected area of the whole grains possess excellent rapid development properties. With such tabular grains, too, those with the aforesaid structure are more advantageous.

The average size of the grains (i.e., the average diameter of spheres having the same volume) of silver halide emulsions to be used in the present invention, is preferably $0.1\mu$ to $2\mu$, particularly preferably $0.15\mu$ to $1.4\mu$.

The grain size distribution may be narrow or broad, with mono-disperse emulsions being preferred. Particularly monodisperse emulsions containing regular form or tabular grains are preferred in the present invention. Emulsions wherein 85% or more, particularly 90% or more, in number or by weight of the whole grains are within the range of the average grain size $\pm 20\%$ are preferred. Particularly preferable results can be obtained by using two or more of such mono-disperse emulsions (particularly mono-disperse emulsions containing cubic, octahedral or tetradecahedral grains) as a mixture or separately in two or more layers.

The photographic emulsion to be used in the present invention may be prepared by the processes described in P. Grafkides, "Chimie et Physique Photographique" (Paul Montel, 1967), G. F. Duffin, "Photographic Emulsion Chemistry" (Focal Press, 1966), V. L. Zelikman et al., "Making and Coating Photographic Emulsion" (Focal Press, 1964), etc. That is, any of an acidic process, a neutral process and an ammoniacal process may be used. As a manner of reacting a soluble silver salt with a soluble halide salt, any one of single-jet method, double-jet method, and a combination thereof may be employed. A process of forming silver halide grains in the presence of excess silver ions (called a reverse mixing process) may be employed as well. As one type of double-jet method, a process called a controlled double-jet method, wherein pAg in a liquid phase in which silver halide is formed is kept constant, may be employed. This process provides a mono-disperse silver halide emulsion containing silver halide grains of regular crystal form having a narrow grain size distribution. The aforementioned grains preferably used in the present invention, are desirably prepared based on the double-jet method.

During formation or physical ripening of silver halide grains, any of cadmium salts, zinc salts, lead salts, thallium salts, iridium salts or the complex salts thereof, rhodium salts or the complex salts thereof, iron salts or the complex salts thereof, etc., may be allowed to coexist.

Particularly, iridium salts or their complex salts are used in amounts of $10^{-9}$ to $10^{-4}$ mol, more preferably $10^{-8}$ to $10^{-5}$ mol, per mol of silver halide. Emulsions prepared by using these salts are particularly useful for obtaining rapid developability and stability in high- or low-illuminance exposure outside the proper exposure illuminance region in comparison with emulsions prepared without using them.

The physical ripening of emulsions in the presence of known silver halide solvents (e.g., ammonia, potassium thiocyanate, thioethers and thione compounds, as described in U.S. Pat. No. 3,271,157, Japanese Patent Application (OPI) Nos. 12360/76, 82408/78, 144319/78, 100717/79, 155828/79, etc.) yields mono-disperse silver halide emulsions having a regular crystal form and a narrow grain size distribution.

In removing soluble salts from physically ripened emulsions, any one of a noodle-washing process, a flocculation-precipitating process, an ultrafiltration process, etc., may be utilized.

The silver halide emulsion to be used in the present invention may be chemically sensitized by applying a sulfur or selenium sensitization process, a reduction sensitization process, a noble metal sensitization process, etc., alone or in combination. That is, sulfur sensitization using active gelatin or sulfur-containing compounds capable of reacting with silver ion (e.g., thiosulfates, thiourea compounds, mercapto compounds, rhodanin compounds, etc.); reduction sensitization using a reductive substance (e.g., a stannous salt, an amine, a hydrazine derivative, formamidinesulfinic acid, a silane compound, etc.); and noble metal sensitization using metal compounds (e.g., a gold complex salt, a complex salt of the group VIII metal in the periodic table such as Pt, Ir, Pd, Rh, Fe, etc.) may be employed alone or in combination. With the silver chlorobromide which can be used in the present invention, the sulfur sensitization process or the selenium sensitization processes are preferably used and, upon such sensitization, hydroxyazaindene compounds are preferably allowed to exist.

In addition to the silver halide emulsion layers, protective layers, and interlayers, all described above, there may further be provided auxiliary layers such as a filter layer, an antihalation layer, a backing layer, etc., in the light-sensitive material used in the present invention.

As a binder or protective colloid to be used for emulsion layers or interlayers used in the present invention, gelatin is advantageously used. However, other hydrophilic colloids may be used as well.

Supports preferable for the light-sensitive materials used in the present invention are reflective supports such as baryta paper, polyethylene-coated paper, polypropylene synthetic paper, transparent supports having a reflective layer or using a reflective body in combination, glass plate, vinyl chloride resin, cellulose acetate, cellulose nitrate, polyester films (e.g., polyethylene terephthalate film), polyamide films, polycarbonate films, polystyrene films, etc. These are properly selected depending upon the end-use of light-sensitive materials.

Color developers which can be used in the present invention are described below. The color developer to be used in the present invention contains a known aromatic primary amine color developing agent. Preferable examples thereof are p-phenylenediamine derivatives, and typical examples are described below which, however, do not limit the present invention in any way.

(D-1) N,N-diethyl-p-phenylenediamine
(D-2) 2-Amino-5-diethylaminotoluene
(D-3) 2-Amino-5-(N-ethyl-N-laurylamino)toluene
(D-4) 4-[N-Ethyl-N-(β-hydroxyethyl)amino]aniline
(D-5) 2-Methyl-4-[N-ethyl-N-(β-hydroxyethyl-)amino]aniline
(D-6) 4-Amino-3-methyl-N-ethyl-N-[β-(methanesulfonamido)ethyl]aniline
(D-7) N-(2-amino-5-diethylaminophenylethyl)methanesulfonamide
(D-8) N,N-Dimethyl-p-phenylenediamine
(D-9) 4-Amino-3-methyl-N-ethyl-N-methoxyethylaniline
(D-10) 4-Amino-3-methyl-N-ethyl-N-β-ethoxyethylaniline
(D-11) 4-Amino-3-methyl-N-ethyl-N-β-butoxyethylaniline Among the above-described p-phenylenediamine derivatives, 4-amino-3-methyl-N-ethyl-N-[β-(methanesulfonamido)ethyl]aniline (D-6) is particularly preferred.

These p-phenylenediamine derivatives may be in the form of salts such as sulfates, hydrochlorides, sulfites, p-toluenesulfonates, etc. The aromatic primary amine developing agents are used in amounts of preferably about 0.1 g to about 20 g, and more preferably about 0.5 g to about 10 g, per liter of a developer.

The color developer preferably has a pH of from 9 to 12, more preferably from 9 to 11.0. Detailed descriptions of kinds and amounts of preservatives, buffer agents, chelating agents, development accelerators, antifoggants, and brightening agents, are described in Japanese Patent Application No. 63526/87, on pages 1 to 19 (corresponding to U.S. Ser. No. 169,633 filed Mar. 17, 1988 on pages 75 to 85).

The processing temperature of the color developer to be employed in the present invention ranges from 20° to 50° C, preferably from 30° to 40° C. The processing time ranges from 20 seconds to 5 minutes, preferably from 30 seconds to 2 minutes. As to the amount of replenisher, the smaller the better, and an amount of from 20 to 600 ml per $m^2$ of light-sensitive material is usually employed, with an amount of from 50 to 300 ml being preferable, and an amount of from 100 to 200 ml being more preferable.

The silver-removing process in the present invention is described below. The silver-removing process may generally be any of a bleaching step-a fixing step; a fixing step-a bleach-fixing step; a bleaching step-a bleach-fixing step; a bleach-fixing step; etc. The silver-removing process is completed in not longer than 2 minutes, and preferably from 15 seconds to 90 seconds.

As to the bleaching solution, bleach-fixing solution, fixing solution, and kinds and amounts of additives thereto, those described in, for example, the Japanese Patent Application No. 63526/87, pp. 20 to 25 (corresponding to U.S. Ser. No. 169,633 filed Mar. 17, 1988 on pp. 85 to 90) may be applied.

As to the water-washing or stabilizing processing to be conducted after the silver-removing processing, reference may also be made to the aforesaid patent application specification, page 25 to page 29, line 12 (corresponding to U.S. Ser. No. 169,633 filed Mar. 17, 1988 on pp. 90 to 99).

The process of the present invention may be applied to any processing step using a color developer. For example, it is applicable to the processing of color paper, color reversal paper, color direct positive light-sensitive materials, color positive-working films, color negative-working films, color reversal films, etc., with application to color paper and color reversal paper being particularly preferable.

The present invention is now illustrated in greater detail by reference to the following examples which, however, are not to be construed as limiting the present invention in any way.

EXAMPLE 1

A multi-layer photographic printing paper A-1 having the layer constitution shown below on a paper support, both surfaces of which were laminated with polyethylene, was prepared. Coating solutions used were prepared as follows. (Preparation of coating solution for forming first layer)

27.2 ml of ethyl acetate and 7.7 ml (8.0 g) of a high-boiling solvent (Solv-1) were added to a mixture of 10.2 g of yellow coupler (Y-1), 9.1 g of yellow coupler (Y-2), and 4.4 g of color image stabilizer (Cpd-1) to prepare a solution. This solution was emulsified and dispersed in 185 ml of a 10% gelatin aqueous solution containing 8 ml of 10% sodium dodecylbenzenesulfonate. This emulsion dispersion was mixed with emulsion EM1 or EM2 to adjust the gelatin concentration to the following formulation. Coating solutions for forming the second to seventh layers were also prepared in the same manner as with the coating solution for forming a first layer. As a gelatin hardener for each layer, 1-hydroxy-3,5-dichloro-s-triazine sodium salt was used. In addition, (Cpd-12) was used as a thickening agent for the coating solutions. (Layer constitution)

Formulations of the respective layers are shown below. The amounts represent coated amounts (g/m$^2$). Amounts of coated silver halide emulsions are presented as silver amounts.

Support (containing a white pigment ($TiO_2$) and a bluing dye in polyethylene on the side of first layer)

1st Layer (blue-sensitive layer)

| | |
|---|---|
| Mono-disperse AgClBr emulsion (EM1) spectrally sensitized with sensitizing dye (ExS-1) | 0.13 |
| Mono-disperse AgClBr emulsion (EM2) spectrally sensitized with sensitizing dye (ExS-1) | 0.13 |
| Gelatin | 1.86 |
| Yellow Coupler (Y-1) | 0.44 |
| Yellow Coupler (Y-2) | 0.39 |
| Color image stabilizer (Cpd-1) | 0.19 |
| Solvent (Solv-1) | 0.35 |

2nd Layer (color mixing-preventing layer)

| | |
|---|---|
| Gelatin | 0.99 |
| Color mixing-preventing agent (Cpd-3) | 0.08 |

3rd Layer (green-sensitive layer)

| | |
|---|---|
| Mono-disperse AgClBr emulsion (EM3) spectrally sensitized with sensitizing dyes (ExS-2, 3) | 0.05 |
| Mono-disperse AgClBr emulsion (EM4) spectrally sensitized with sensitizing dyes (ExS-2, 3) | 0.11 |
| Gelatin | 1.80 |
| Magenta Coupler (M-3) | 0.32 |
| Color image stabilizer (Cpd-2) | 0.24 |
| Solvent (Solv-2) | 0.12 |
| Solvent (Solv-3) | 0.25 |
| Color image stabilizer (Cpd-8) | 0.03 |

-continued

| | |
|---|---|
| Color image stabilizer (Cpd-9) | 0.02 |

4th Layer (UV ray-absorbing layer)

| | |
|---|---|
| Gelatin | 1.60 |
| UV ray absorbent (UV-1) | 0.62 |
| Color mixing-preventing agent (Cpd-3) | 0.05 |
| Solvent (Solv-4) | 0.24 |

5th Layer (red-sensitive layer)

| | |
|---|---|
| Mono-disperse AgClBr emulsion (EM5) spectrally sensitized with sensitizing dyes (ExS-4, 5) | 0.07 |
| Mono-disperse AgClBr emulsion (EM6) spectrally sensitized with sensitizing dyes (ExS-4, 5) | 0.16 |
| Gelatin | 1.44 |
| Cyan Coupler (I-1) | 0.34 |
| Color image stabilizer (Cpd-10) | 0.17 |
| Polymer for dispersion (Cpd-11) | 0.31 |
| Solvent (Solv-2) | 0.14 |

6th Layer (UV ray-absorbing layer)

| | |
|---|---|
| Gelatin | 0.54 |
| UV ray absorbent (UV-1) | 0.21 |
| Solvent (Solv-4) | 0.08 |
| Stabilizing agent (Cpd-3) | 0.02 |

7th Layer (protective layer)

| | |
|---|---|
| Gelatin | 1.33 |
| Acryl-modified copolymer of polyvinyl alcohol (modification degree: 17%) | 0.17 |
| Liquid paraffin | 0.03 |

In this preparation, (Cpd-4) and (Cpd-5) were used as irradiation-preventing dyes.

Further, Alkanol XC (made by Dupont), sodium alkylbenzenesulfonate, succinate, and Magefacx F-120 (made by Dai Nippon Ink & Chemicals, Inc.) were used as emulsifying and dispersing agents or coating aids. (Cpd-6) and (Cpd-7) were used as stabilizers for silver halide.

The compounds used in this Example are shown below. The couplers are shown in the foregoing specific examples.

ExS-1

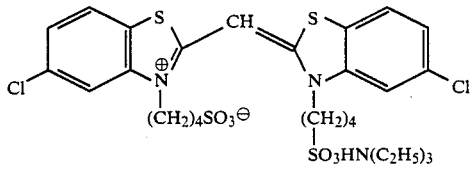

-continued
ExS-2
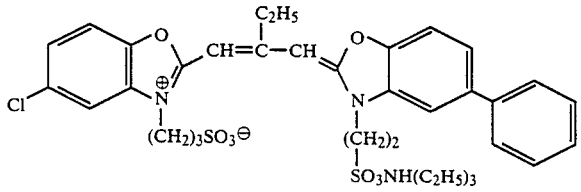
ExS-3
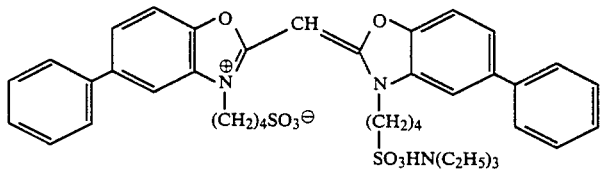
ExS-4
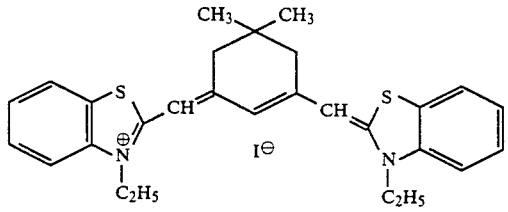
ExS-5
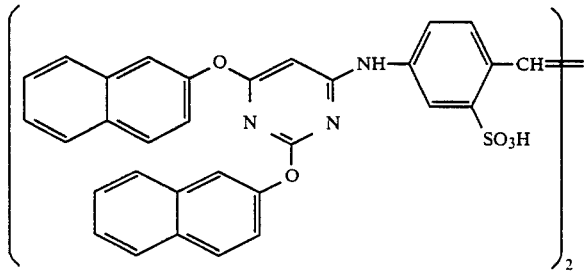
Cpd-1
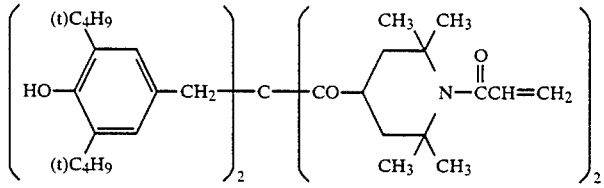
Cpd-2
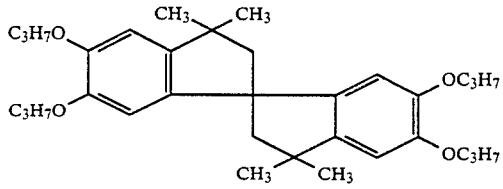
Cpd-3
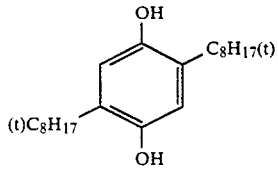

-continued
Cpd-4
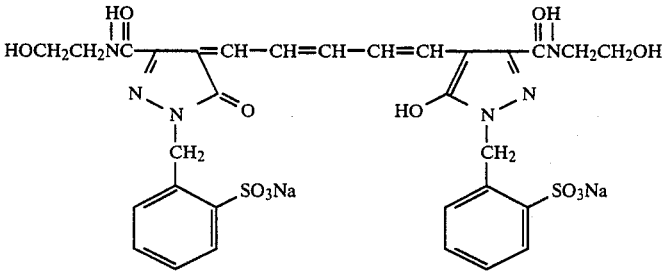
Cpd-5
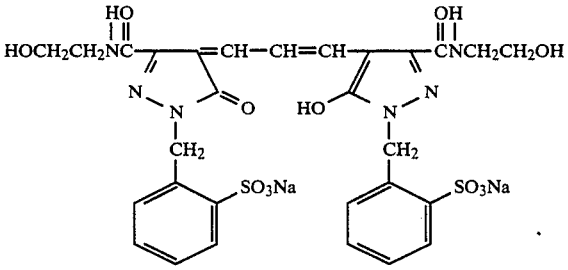
Cpd-6
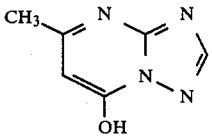
Cpd-7
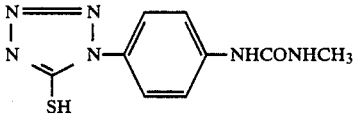
Cpd-8
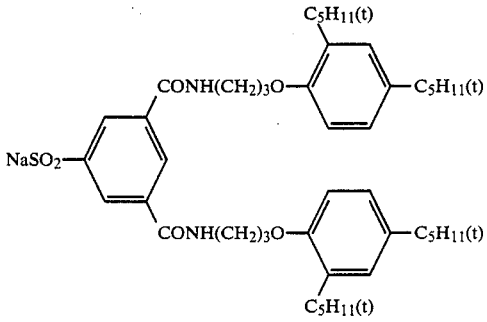
Cpd-9
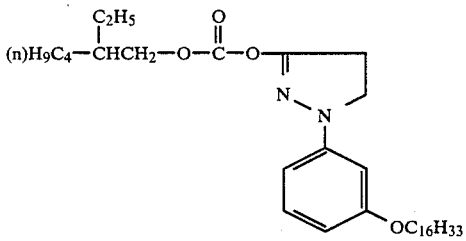
(Ultraviolet ray absorbent)
2:9:8 (by weight) mixture of:
UV-1
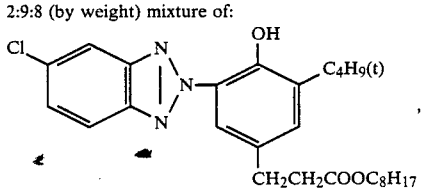

-continued
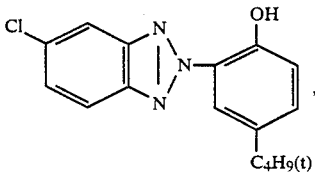
, and
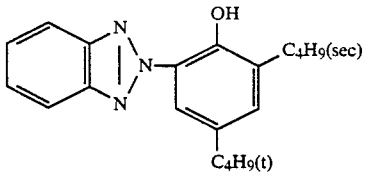
(Color image stabilizer)
5:8:9 (by weight) mixture of:
Cpd-10
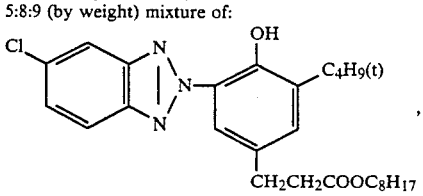
,
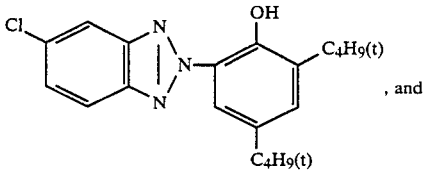
, and
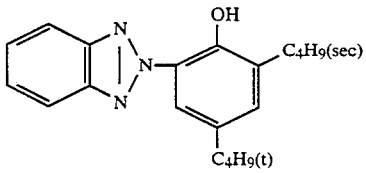
Cpd-11
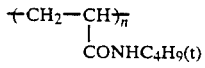
Average molecular weight: 80,000
Cpd-12
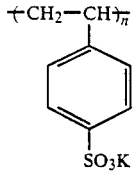
Average molecular weight: 750,000
Solv-1: Dibutyl phthalate
Solv-2: Tricresyl phosphate
Solv-3: Trioctyl phosphate
Solv-4: Trinonyl phosphate
Solvent-5:
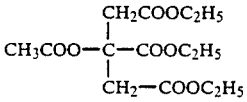
Solvent-6:
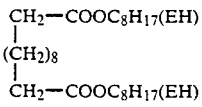
-continued
Solvent-7:
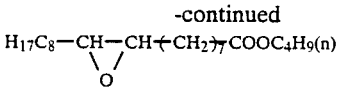
Solvent-8:
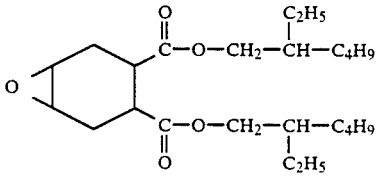
Solvent-9:
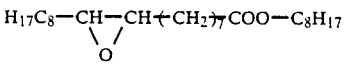

Silver halide emulsions used in this Example are shown below.

EM1 to EM6: Silver chlorobromide

| Emulsion | Grain Form | Average Diameter*1 (μ) | Br (mol %) | Variation Coefficient*2 |
|---|---|---|---|---|
| EM1 | cube | 1.0 | 80 | 0.08 |
| EM2 | " | 0.75 | 80 | 0.07 |
| EM3 | " | 0.5 | 83 | 0.09 |
| EM4 | " | 0.4 | 83 | 0.10 |
| EM5 | " | 0.5 | 73 | 0.09 |
| EM6 | " | 0.4 | 73 | 0.10 |

*1: Average of projected edge length

**2: Presented in terms of the ratio of the standard deviation (s) to average diameter ($\bar{d}$) (i.e., s/$\bar{d}$) employed in statistics.

Then, samples (A-2) to (A-14) were prepared in the same manner as sample (A-1), except for changing the formulation of the 5th layer (red-sensitive layer) to that shown in Table 1 (i.e., changing the kind of the coupler and adding an additive).

Four sheets of samples were prepared with each of these samples (A-1) to (A-14), and were exposed through an optical wedge, then processed according to the following processing (I), provided that the pH of the bleach-fixing solution was adjusted to (a) to (d), and that the four sheets were respectively passed through the bleach-fixing solutions having the different pH values set forth below. pH of bleach-fixing solution:

(a): 5.5

(b): 6.0

(c): 6.3

(d): 6.8

Processing (I):

| Processing Step | Temperature | Time |
|---|---|---|
| Color development | 38° C. | 1 min. 40 sec. |
| Bleach-fixing | 30–34° C. | 1 min. |
| Rinsing (1) | 30–34° C. | 20 sec. |
| Rinsing (2) | 30–34° C. | 20 sec. |
| Rinsing (3) | 30–34° C. | 20 sec. |
| Drying | 70–80° C. | 50 sec. |

(Rinsing was conducted in a three-tank counter current manner in the order of (3)→(1).)

The formulations of the respective processing solutions are as shown below.

Color developer

| | |
|---|---|
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Triethylenediamine(1,4-diazabicyclo-(2,2,2)octane) | 5.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Diethylhydroxylamine | 4.0 g |
| Brightening agent (UNITEX-CK, made by CIBA GEIGY) | 1.5 g |
| Water to make | 1000 ml |
| pH (25° C.) | 10.25 |

Bleach-fixing solution

| | |
|---|---|
| Water | 400 ml |
| Ammonium thiosulfate (70%) | 200 ml |
| Sodium sulfite | 20 g |
| Ammonium ethylenediaminetetraacetato ferrate | 60 g |
| Disodium ethylenediaminetetraacetate | 10 g |
| Water to make | 1000 ml |
| pH (25° C.) | adjusted to (a) to (d) described hereinbefore |

Rinsing solution

Ion-exchange water (containing up to 3 ppm of Ca and up to 3 ppm of Mg)

The thus obtained color images were subjected to cyan density measurement using Fuji-Densitometer (Model MAD-8509) in order to obtain the characteristic curve thereof. These samples were oxidation-processed as shown below. Oxidation processing:

| Processing Step | Temperature | Time |
|---|---|---|
| Oxidizing bath | 38° C. | 5 min. |
| Washing with water | 15–23° C. | 10 min. |
| Drying | 70–80° C. | 50 sec. |

Oxidizing bath

| Oxidizing bath | |
|---|---|
| Water | 800 ml |
| Potassium ferricyanide | 5 g |
| Water to make | 1000 ml |

Cyan densities of the thus oxidation-processed samples were again measured in order to obtain the characteristic curve thereof. The densities before the oxidation processing corresponding to the density of 2.00 after the processing were read to determine how low the density was before the oxidation processing in comparison with that after the processing. Specifically, an exposure amount necessary to obtain the density of 2.0 was read from the characteristic curve after the processing and then the density (A) corresponding to the exposure amount was read from the characteristic curve before the processing. The decrease in density was calculated by the equation: 2.0-A. That is, the degree of color restoration failure was examined. The results are also shown in Table 1.

TABLE 1

| Sample | Changed Matter in 5th Layer Formulation** | | | Decrease in Cyan Density of Light-Sensitive Material | | | |
|---|---|---|---|---|---|---|---|
| No. | Coupler* | Additive (g/m²) | | pH = 5.5*** | pH = 6.0*** | pH = 6.3*** | pH = 6.8*** |
| A-1 | I-1 | — | | 0.17 | 0.12 | 0.08 | 0.04 |
| A-2 | " | Comparative Compound (B) | 0.011 | 0.17 | 0.13 | 0.08 | 0.05 |
| A-3 | " | Comparative Compound (E) | 0.011 | 0.16 | 0.12 | 0.09 | 0.04 |

TABLE 1-continued

| Sample No. | Changed Matter in 5th Layer Formulation** Coupler* | Additive (g/m²) | | Decrease in Cyan Density of Light-Sensitive Material pH = 5.5*** | pH = 6.0*** | pH = 6.3*** | pH = 6.8*** |
|---|---|---|---|---|---|---|---|
| A-4 | " | Illustrative Compound III-8 | 0.011 | 0.08 | 0.04 | 0.03 | 0.04 |
| A-5 | " | Illustrative Compound II-10 | 0.011 | 0.07 | 0.04 | 0.03 | 0.03 |
| A-6 | " | Illustrative Compound II-4 | 0.011 | 0.07 | 0.03 | 0.03 | 0.04 |
| A-7 | " | Illustrative Compound II-3 | 0.011 | 0.05 | 0.02 | 0.03 | 0.03 |
| A-8 | I-8/I-18 (1/1 molar ratio) | — | | 0.24 | 0.15 | 0.08 | 0.02 |
| A-9 | I-8/I-18 (1/1 molar ratio) | Comparative Compound (B) | 0.011 | 0.24 | 0.16 | 0.09 | 0.02 |
| A-10 | I-8/I-18 (1/1 molar ratio) | Comparative Compound (E) | 0.011 | 0.22 | 0.14 | 0.08 | 0.02 |
| A-11 | I-8/I-18 (1/1 molar ratio) | Illustrative Compound III-8 | 0.011 | 0.11 | 0.06 | 0.04 | 0.01 |
| A-12 | I-8/I-18 (1/1 molar ratio) | Illustrative Compound II-10 | 0.011 | 0.06 | 0.04 | 0.02 | |
| A-13 | I-8/I-18 (1/1 molar ratio) | Illustrative Compound II-4 | 0.011 | 0.09 | 0.04 | 0.03 | 0.01 |
| A-14 | I-8/I-18 (1/1 molar ratio) | Illustrative Compound II-3 | 0.011 | 0.09 | 0.04 | 0.03 | 0.02 |

*Amount of coupler was equimolar to A-1. Solvent-2 was used in a 0.6-fold amount of coupler.
**Except for the changed matter, absolutely the same as with A-1.
***pH of bleach-fixing solution Comparative Compound (B)

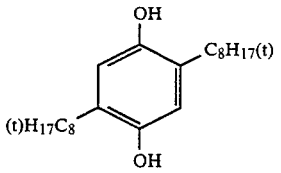

Comparative Compound (E)

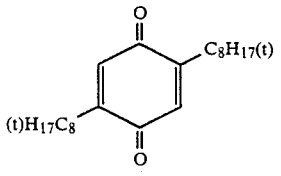

It is seen from the results shown in Table 1 that a large color restoration failure takes place when the use of cyan coupler I-1 or a mixture of I-8/I-18 is combined with bleach-fixing at a low pH. Addition of comparative compounds (B) and (E) fail to overcome the color restoration failure.

Samples A-4 to A-7 and A-11 to A-14, to which the illustrative compounds of the present invention III-8, II-10, II-4, and II-3 had been added, showed markedly improved color restoration properties. However, when processed in a bleach-fixing bath having a pH of 6.8, the samples showed almost no improving effects, regardless of the kind of additives. Thus, it is seen that the illustrative compounds of the present invention provide particularly large effects when bleach-fixing is conducted at a low pH.

More marked effects of the present invention were obtained when the above-described light-sensitive material samples were passed through a processing solution under a so-called running state which was adulterated with the color developer.

EXAMPLE 2

Samples (B-1) to (B-41) were prepared in the same manner as with sample (A-1) in Example 1, except for changing the formulation of the 5th layer to that shown in Table 2 (i.e., changing the kind of coupler and adding an additive).

Two sheets of samples were prepared with each of these samples (B-1) to (B-41), and were exposed through an optical wedge. One of the sheets was subjected to processing (I) (same as processing (I) in Example 1 employing a bleach-fixing solution having a pH of 5.50), and the other to processing (II) shown below.

Processing (II):

| Processing Step | Temperature | Time |
|---|---|---|
| Color development | 38° C. | 1 min. 40 sec. |
| Bleach-fixing | 30–34° C. | 1 min. |
| Rinsing (1) | 30–34° C. | 20 sec. |
| Rinsing (2) | 30–34° C. | 20 sec. |
| Rinsing (3) | 30–34° C. | 20 sec. |
| Drying | 70–80° C. | 50 sec. |

(Rinsing was conducted in a three-tank counter current manner in the order of (3)→(1).)

Color developer

| | |
|---|---|
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Benzyl alcohol | 16 ml |
| Diethylene glycol | 10 ml |
| Sodium sulfite | 2.0 g |
| Potassium bromide | 0.5 g |
| Potassium carbonate | 30 g |
| N-Ethyl-N-(β-methanesulfonamidoethyl)-3-methyl-4-aminoaniline sulfate | 5.5 g |
| Hydroxylamine sulfate | 3.0 g |
| Diaminostilbene-type Brightening agent (WHITEX 4B, made by Sumitomo Chemical Co., Ltd ) | 1.5 g |
| Water to make | 1000 ml |
| pH (25° C.) | 10.25 |

Bleach-fixing solution

| | |
|---|---|
| Water | 400 ml |
| Ammonium thiosulfate (70%) | 200 ml |
| Sodium sulfite | 20 g |
| Ammonium ethylenediaminetetraacetato ferrate | 60 g |
| Disodium ethylenediaminetetraacetate | 10 g |
| Water to make | 1000 ml |
| pH (25° C.) | 5.50 |

Rinsing solution

| | |
|---|---|
| Benzotriazole | 1.0 g |
| Ethylenediamine-N,N,N',N'-tetra-methylenephosphonic acid | 0.3 g |
| Water to make | 1000 ml |
| pH (25° C.) | 7.50 |

The thus obtained color images were subjected to measurement of density, oxidation processing, etc. in the same manner as in Example 1 to examine the degree of color restoration failure. The results thus obtained are given in Table 2.

TABLE 2

| Sample No. | Changed Matter in 5th Layer Formulation** Coupler* | Additive | Amount (g/m²) | Decrease in Cyan Density of Light-Sensitive Material (I)*** | (II)*** | Note |
|---|---|---|---|---|---|---|
| B-1 | I-1 | — | | 0.17 | 0.25 | Comparison |
| B-2 | " | Comparative Compound (A) | 0.008 | 0.17 | 0.25 | " |
| B-3 | " | Compound (B) | 0.011 | 0.16 | 0.24 | " |
| B-4 | " | Compound (C) | 0.018 | 0.17 | 0.24 | " |
| B-5 | " | Compound (D) | 0.008 | 0.17 | 0.23 | " |
| B-6 | " | Compound (E) | 0.011 | 0.16 | 0.25 | " |
| B-7 | " | Compound (F) | 0.018 | 0.16 | 0.25 | " |
| B-8 | " | Illustrative Compound II-1 | 0.008 | 0.08 | 0.13 | Present Invention |
| B-9 | " | Compound II-3 | 0.011 | 0.06 | 0.10 | Present Invention |
| B-10 | " | Compound II-5 | 0.014 | 0.06 | 0.11 | Present Invention |
| B-11 | " | Compound II-10 | 0.011 | 0.07 | 0.11 | Present Invention |
| B-12 | " | Compound II-12 | 0.014 | 0.09 | 0.15 | Present Invention |
| B-13 | " | Compound III-2 | 0.011 | 0.06 | 0.10 | Present Invention |
| B-14 | " | Compound III-4 | 0.011 | 0.06 | 0.12 | Present Invention |
| B-15 | I-1 | Illustrative Compound III-7 | 0.011 | 0.06 | 0.10 | Present Invention |
| B-16 | " | Illustrative Compound III-8 | 0.011 | 0.07 | 0.12 | Present Invention |
| B-17 | I-1 | Illustrative Compound II-10<br>Illustrative Compound III-7 | 0.005<br>0.006 | 0.06 | 0.12 | Present Invention |
| B-18 | I-1 | Illustrative Compound II-6<br>Illustrative Compound III-8 | 0.006<br>0.006 | 0.06 | 0.11 | Present Invention |
| B-19 | II-1 | Illustrative Compound II-1<br>Illustrative Compound III-7 | 0.006<br>0.005 | 0.07 | 0.11 | Present Invention |
| B-20 | II-12 | Illustrative Compound II-12<br>Illustrative Compound III-9 | 0.007<br>0.007 | 0.008 | 0.14 | Present Invention |
| B-21 | I-2 | — | | 0.08 | 0.13 | Comparison |
| B-22 | I-2 | Illustrative Compound II-1<br>Illustrative Compound III-6 | 0.002<br>0.003 | 0.02 | 0.05 | Present Invention |
| B-23 | " | Compound II-10 | 0.003 | 0.03 | 0.05 | Present Invention |
| B-24 | I-7 | — | | 0.24 | 0.30 | Comparaison |
| B-25 | " | Illustrative Compound II-7 | 0.012 | 0.10 | 0.13 | Present Invention |
| B-26 | " | Compound II-10 | 0.011 | 0.12 | 0.15 | Present Invention |
| B-27 | I-7 | Illustrative Compound II-10<br>Illustrative Compound III-4 | 0.005<br>0.006 | 0.11 | 0.14 | Present Invention |
| B-28 | I-8 | — | | 0.30 | 0.41 | Comparison |
| B-29 | " | Illustrative | 0.013 | 0.15 | 0.18 | Present |

TABLE 2-continued

| Sample No. | Changed Matter in 5th Layer Formulation** Coupler* | Additive | Amount (g/m²) | Decrease in Cyan Density of Light-Sensitive Material (I)*** | (II)*** | Note |
|---|---|---|---|---|---|---|
| | | Compound II-3 | | | | Invention |
| | | Illustrative | 0.006 | 0.16 | 0.19 | Present |
| B-30 | " | Compound II-3 | | | | Invention |
| | | Illustrative | 000.7 | | | Present |
| | | Compound III-10 | | | | Invention |
| B-31 | I-10 | — | | 0.07 | 0.12 | Comparison |
| B-32 | " | Illustrative | 0.015 | 0.00 | 0.02 | Present |
| | | Compound II-10 | | | | Invention |
| B-33 | " | Illustrative | 0.015 | 0.00 | 0.03 | Present |
| | | Compound III-4 | | | | Invention |
| B-34 | I-1/I-12 | — | | 0.10 | 0.15 | Comparison |
| | (1/1 molar ratio) | | | | | |
| B-35 | I-1/I-12 | Illustrative | 0.013 | 0.01 | 0.02 | Present |
| | (1/1 molar ratio) | Compound II-14 | | | | Invention |
| B-36 | I-1/I-12 | Illustrative | 0.018 | 0.02 | 0.33 | Comparison |
| | (1/1 molar ratio) | Compound III-5 | | | | |
| B-37 | I-8/I-19 | — | | 0.23 | 0.33 | Comparison |
| | (1/1 molar ratio) | | | | | |
| B-38 | I-8/I-19 | Illustrative | 0.011 | 0.02 | 0.15 | Present |
| | (1/1 molar ratio) | Compound II-10 | | | | Invention |
| B-39 | I-8/I-19 | Illustrative | 0.022 | 0.07 | 0.09 | Present |
| | (1/1 molar ratio) | Compound II-10 | | | | Invention |
| | | Illustrative | 0.011 | 0.06 | 0.10 | Present |
| B-40 | I-8/I-19 | Compound II-10 | | | | Invention |
| | (1/1 molar ratio) | Illustrative | 0.011 | | | |
| | | Compound III-8 | | | | |
| B-41 | I-8/I-19 | Illustrative | 0.022 | 0.21 | 0.30 | Comparison |
| | (1/1 molar ratio) | Compound (E) | | | | |

*Amount of coupler was equimolar A-1. Solvent-2 was used in a 0.6-fold amount of coupler.
**Except for the changed matter, absolutely the same as with A-1.
Processing Type Comparative compounds (A) to (F) used in this Example are shown below.

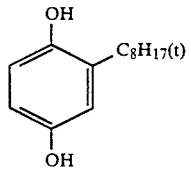

Comparative Compound (A)

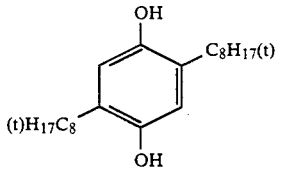

Comparative Compound (B)

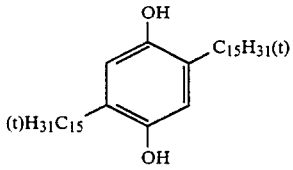

Comparative Compound (C)

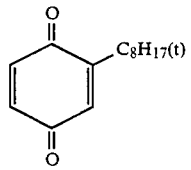

Comparative Compound (D)

-continued

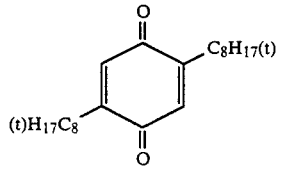

Comparative Compound (E)

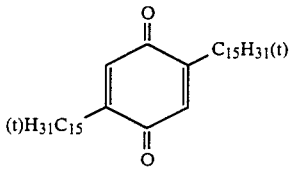

Comparative Compound (F)

It is seen from the results shown in Table 2 that the addition of the illustrative compounds of the present invention serves to markedly improve color restoration properties when bleach-fixing is conducted at a low pH. In the case of conducting processing (II) containing benzyl alcohol in the color developer, color restoration failure which tends to increase in comparison with processing (I) not using benzyl alcohol, is markedly depressed by addition of the illustrative compounds of the present invention. Comparative compound (A) to (F) are scarcely effective in both processing types.

When samples obtained in the same manner as in Example 2, except for changing the solvent in the 5th layer (Solv-2) to the foregoing solvents: Solv-1, Solv-3, Solvent-5, Solvent-6, Solvent-7, Solvent -8 or Solvent-9, were subjected to the same tests employing both processing (I) and (II), those samples to which the illustrative compounds of the present invention were added also showed markedly improved color restoration properties as in Example 2.

Further, similar effects were obtained when the bleach-fixing step in both processing (I) and (II) in Example 2 was separated into a bleaching step (30° to 34° C., 1 min.) and a fixing step (30° to 34° C., 1 min.).

With light-sensitive materials wherein the light-sensitive silver halide emulsions in the red-sensitive layer, green-sensitive layer, and blue-sensitive layer was replaced by silver chloride, those wherein the illustrative compounds of the present invention were added to the red-sensitive layer showed markedly improved color restoration properties as in Example 2.

From the results shown above, it can be seen that when light-sensitive materials wherein the cyan coupler represented by formula (I), combined with a specific hydroquinone and/or a specific quinone, are subjected to a rapid processing using low pH bleach-fixing solution, the color restoration properties of dye image produced from cyan coupler are markedly improved and the color balance after the processing is good.

While the invention has been described in detail and with reference to specific embodiments thereof, it will be apparent to one skilled in the art that various changes and modifications can be made therein without departing from the spirit and scope thereof.

What is claimed is:

1. An image-forming process, which comprises subjecting a multilayer silver halide photographic material containing, in an oil droplet dispersion in a light-sensitive layer provided on a support, at least one diffusion-resistant oil-soluble coupler capable of coupling with an oxidation product of an aromatic primary amine developing agent to form a substantially non-diffusible cyan dye represented by the following formula (I) and at least one member selected from the compounds represented by the following formulae (II) and (III), to imagewise exposure and color development, and then processing said multilayer silver halide photographic material with a bleaching or bleach-fixing solution having a pH of 6.3 or less:

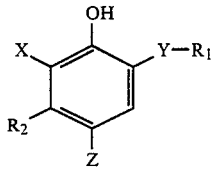

(I)

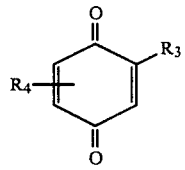

(II)

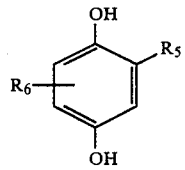

(III)

wherein:

Y represents —NHCO— or —CONH—;

$R_1$ represents an aliphatic group, an aromatic group, a heterocyclic group or an amine group;

X represents a hydrogen atom, a halogen atom, an aliphatic group, an alkoxy group or an acylamino group;

$R_2$ represents an alkyl group or an acylamino group or, when bound to X, non-metallic atoms forming a 5- to 7-membered ring;

Z represents a hydrogen atom or a group capable of being eliminated upon coupling with an oxidation product of a developing agent; and $R_3$, $R_4$, $R_5$, and $R_6$ each represents a hydrogen atom, a straight chain, cyclic or branched alkyl or alkylthio group, provided that $R_3$ and $R_4$, or $R_5$ and $R_6$, do not represent hydrogen atoms at the same time and that at least one of $R_5$ and $R_6$ or at least one of $R_5$ and $R_6$ represents a branched or straight chain alkyl group having 8 to 20 carbon atoms and that, when they represent alkyl groups, those which are bound to the benzene ring via a tertiary carbon atom are excluded.

2. An image-forming process as in claim 1, wherein $R_2$ represents an alkyl group containing 1 to 15 carbon atoms; Z represents a hydrogen atom or a halogen atom; X represents a halogen atom and $R_3$, $R_4$, $R_5$ and $R_6$ each represents branched or chain alkyl groups containing 8 to 20 carbon atoms.

3. An image-forming process as in claim 1, wherein said couplers represented by formula (I) are present in an amount of from 0.1 to 1 mole, per mole of silver halide.

4. An image-forming process as in claim 1, wherein said compounds represented by formulae (II) and/or (III) are present in an amount of from 0.1 to 100 mol %, per mole of said coupler represented by formula (I).

5. An image-forming process as in claim 1, wherein the amount ratio of said compound represented by formula (II) to said coupler represented by formula (I) is 1/100 to 10 times.

6. An image-forming process as in claim 1, comprising a silver halide emulsion comprising silver chlorobromide containing silver iodide in an amount of 3 mol % or less based upon the entire silver halide amount.

7. An image-forming process as in claim 6, wherein said silver chlorobromide emulsion contains at least 10 mol % silver bromide.

8. An image-forming process as in claim 1, wherein said processing is conducted at a temperature of from 20° to 50° C. for a period of from 20 seconds to 5 minutes.

9. An image-forming process as in claim 1, wherein the total number of carbon atoms in each of $R_1$, X, $R_2$ and Z of said coupler represented by formula (I) is up to 30 in case of a monomer.

10. An image-forming process as in claim 1, wherein said oil droplet comprises a substantially water-insoluble and organic solvent-soluble polymer.

11. An image-forming process as in claim 1, wherein $R_3$ and $R_4$ are in the 2,5-substitution relation.

12. An image-forming process as in claim 1, wherein $R_5$ and $R_6$ are in the 2,5-substitution relation.

13. An image-forming process as in claim 1, wherein said photographic material further contains a protective layer and an interlayer, at least one of which layers comprises at least one member selected from the compounds represented by the following formulae (HQ-I), (HQ-II) and (RD-I):

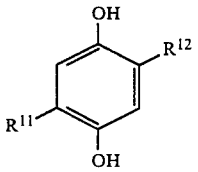
(HQ-I)

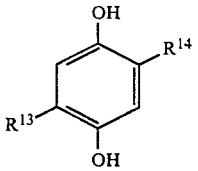
(HQ-II)

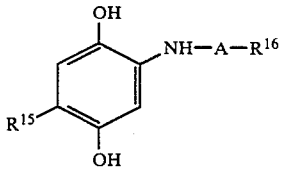
(RD-I)

wherein $R^{11}$ and $R^{12}$ each represents a hydrogen atom or a substituted or unsubstituted alkyl group containing 1 to 60 carbon atoms, with one of $R^{11}$ and $R^{12}$ being an alkyl group; $R^{13}$ represents a substituted or unsubstituted alkyl, alkylthio, amido or alkyloxy group; $R^{14}$ represents a sulfo group or a sulfoalkyl group; $R^{15}$ represents a hydrogen atom, a halogen atom or a substituted or unsubstituted alkyl group; A represents $$-\overset{\overset{\displaystyle O}{\|}}{C}-$$

or $-SO_2-$; and $R^{16}$ represents a substituted or unsubstituted alkyl or aryl group.

14. An image-forming process as in claim 1, wherein a developer comprising a para-phenylenediamine-type developing agent is used at said color development.

15. An image-forming process as in claim 14, wherein the developer is provided with a replenisher and the amount of replenisher for said developer is from 20 to 600 ml per $m^2$ of the photographic material.

16. An image-forming process as in claim 15, wherein said amount of replenisher is from 50 to 300 ml per $m^2$ of the photographic material.

17. An image-forming process as in claim 16, wherein said amount of replenisher is from 100 to 200 ml per $m^2$ of the photographic material.

18. An image-forming process, which comprises subjecting a multilayer silver halide color photographic material containing, in an oil droplet dispersion in a light-sensitive layer provided on a support, at least one of the diffusion-resistant oil-soluble couplers capable of coupling with an oxidation product of an aromatic primary amine developing agent to form a substantially non-diffusible cyan dye represented by the following formula (I) and at least one member selected from the compounds represented by the following formula (II), to imagewise exposure and color development, and then processing said multilayer silver halide photographic material with a bleaching or bleach-fixing solution having a pH of 6.3 or less:

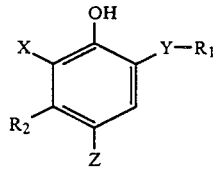
(I)

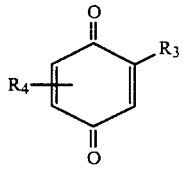
(II)

wherein:

Y represents —NHCO— or —CONH—;

$R_1$ represents an aliphatic group, an aromatic group, a heterocyclic group or an amino group;

X represents a hydrogen atom, a halogen atom, an aliphatic group, an alkoxy group or an acylamino group;

$R_2$ represents an alkyl group or an acylamino group or, when bound to X, non-metallic atoms forming a 5- to 7-membered ring;

Z represents a hydrogen atom or a group capable of being eliminated upon coupling with an oxidation product of a developing agent; and $R_3$, and $R_4$ each represents a hydrogen atom, a chain, cyclic or branched alkyl or alkylthio group, provided that $R_3$ and $R_4$, do not represent hydrogen atoms at the same time and that, when they represent alkyl groups, those which are bound to the benzene ring via a tertiary carbon atom are excluded.

* * * * *